US007611077B2

(12) United States Patent
Sesser et al.

(10) Patent No.: US 7,611,077 B2
(45) Date of Patent: Nov. 3, 2009

(54) ADJUSTABLE FLOW RATE, RECTANGULAR PATTERN SPRINKLER

(75) Inventors: George L. Sesser, Walla Walla, WA (US); Sean M. Scott, Waitsburg, WA (US)

(73) Assignee: Hunter Industries, Inc., San Marcos, CA (US)

( * ) Notice: Subject to any disclaimer, the term of this patent is extended or adjusted under 35 U.S.C. 154(b) by 444 days.

(21) Appl. No.: 11/349,347

(22) Filed: Feb. 8, 2006

(65) Prior Publication Data

US 2007/0181711 A1 Aug. 9, 2007

(51) Int. Cl.
*B05B 3/04* (2006.01)

(52) U.S. Cl. ..... 239/222.11; 239/232; 239/252; 239/262; 239/443; 239/484; 239/514; 239/518

(58) Field of Classification Search ..... 239/205, 239/222.17, 231, 247, 252, 456, 511, 580
See application file for complete search history.

(56) References Cited

U.S. PATENT DOCUMENTS

| | | | | |
|---|---|---|---|---|
| 3,131,867 | A | | 5/1964 | Miller et al |
| 3,884,416 | A | | 5/1975 | King |
| 3,934,820 | A | | 1/1976 | Phaup |
| 3,940,066 | A | | 2/1976 | Hunter |
| 3,955,764 | A | | 5/1976 | Phaup |
| 4,119,275 | A | | 10/1978 | Hunter |
| 4,131,234 | A | * | 12/1978 | Pescetto ..... 239/457 |
| 4,154,404 | A | | 5/1979 | Clawson |
| 4,261,515 | A | | 4/1981 | Rosenberg et al. |
| 4,471,908 | A | | 9/1984 | Hunter |
| 4,579,285 | A | | 4/1986 | Hunter |
| 4,634,052 | A | | 1/1987 | Grizzle et al. |
| RE32,386 | E | | 3/1987 | Hunter |
| 4,815,662 | A | | 3/1989 | Hunter |
| 4,842,201 | A | | 6/1989 | Hunter |
| 4,850,532 | A | | 7/1989 | Mackanos |
| 4,867,379 | A | | 9/1989 | Hunter |
| 4,898,332 | A | | 2/1990 | Hunter et al. |
| 4,932,590 | A | | 6/1990 | Hunter |
| 4,944,456 | A | | 7/1990 | Zakai |
| 4,967,961 | A | | 11/1990 | Hunter |
| 4,971,250 | A | | 11/1990 | Hunter |
| 4,986,474 | A | | 1/1991 | Schisler et al. |
| 5,031,840 | A | | 7/1991 | Grundy et al. |
| 5,058,806 | A | | 10/1991 | Rupar |

(Continued)

OTHER PUBLICATIONS

International Search Report for application No. 07002672.9-1268 dated Mar. 11, 2008.

(Continued)

*Primary Examiner*—Dinh Q Nguyen
(74) *Attorney, Agent, or Firm*—Knobbe Martens Olson & Bear LLP

(57) ABSTRACT

A rotary sprinkler comprising a sprinkler body supporting a nozzle body and a water distribution plate supported on a shaft downstream of said nozzle body, said water distribution plate provided with a plurality of grooves shaped to redirect a stream emitted from said nozzle body and to cause the water distribution plate to rotate when struck by the stream; a stream deflector supported within said sprinkler body and surrounding said nozzle body; wherein said nozzle body and said stream deflector cooperate to produce a substantially rectangular wetted pattern area.

26 Claims, 30 Drawing Sheets

U.S. PATENT DOCUMENTS

| | | | | |
|---|---|---|---|---|
| 5,083,709 | A | 1/1992 | Iwanowski | |
| RE33,823 | E | 2/1992 | Nelson et al. | |
| 5,098,021 | A | 3/1992 | Kah, Jr. | |
| 5,148,990 | A | 9/1992 | Kah, Jr. | |
| 5,226,602 | A | 7/1993 | Cochran et al. | |
| 5,288,022 | A | 2/1994 | Sesser | |
| 5,360,167 | A * | 11/1994 | Grundy et al. | 239/460 |
| 5,556,036 | A | 9/1996 | Chase | |
| 5,647,541 | A | 7/1997 | Nelson | |
| 5,762,270 | A | 6/1998 | Kearby et al. | |
| 5,823,440 | A | 10/1998 | Clark | |
| 5,927,607 | A | 7/1999 | Scott | |
| 6,244,521 | B1 * | 6/2001 | Sesser | 239/222.17 |
| 6,499,672 | B1 | 12/2002 | Sesser | |
| 6,651,905 | B2 | 11/2003 | Sesser et al. | |
| 6,688,539 | B2 | 2/2004 | Griend | |
| 6,736,332 | B2 | 5/2004 | Sesser et al. | |
| 6,942,164 | B2 * | 9/2005 | Walker | 239/204 |
| 6,957,782 | B2 | 10/2005 | Clark et al. | |
| 7,032,836 | B2 * | 4/2006 | Sesser et al. | 239/204 |
| 7,159,795 | B2 | 1/2007 | Sesser et al. | |
| 7,168,634 | B2 * | 1/2007 | Onofrio | 239/222.17 |
| 7,240,860 | B2 | 7/2007 | Griend | |
| 7,322,533 | B2 | 1/2008 | Grizzle | |
| RE40,440 | E | 7/2008 | Sesser | |

OTHER PUBLICATIONS

"Pro-Spray®," *Hunter, The Irrigation Innovators* brochure, 6 pages, May 2005.

* cited by examiner

ADJUSTABLE FLOW RATE, RECTANGULAR PATTERN SPRINKLER

This invention relates to sprinklers and, specifically, to a sprinkler that incorporates an adjustable flow rate feature in combination with a specialized nozzle and stream deflector for creating a substantially rectangular water distribution pattern.

BACKGROUND

It is known to utilize interchangeable arc or other shaped nozzles in sprinklers in order to modify the pattern wetted by the discharge stream, while maintaining a constant flow or precipitation rate in the wetted areas. Typically, these nozzles comprise orifice plates which have a central hole for receiving a shaft that supports the distributor above the nozzle. The orifice itself is generally radially outwardly spaced from the shaft hole in the orifice plate. Representative examples of this type of construction are found in U.S. Pat. Nos. 4,967,961; 4,932,590; 4,842,201; 4,471,908; and 3,131,867. Other arc adjustment techniques are described in U.S. Pat. Nos. 5,556,036; 5,148,990; 5,031,840; 4,579,285; and 4,154,404. It is also known to incorporate adjustable flow rate arrangements in sprinklers, within the context of substantially constant water pressure. For example, see U.S. Pat. Nos. 5,762,270; 4,898,332; and 4,119,275. Such arc adjustment and flow rate adjustment features are often incorporated into pop-up sprinklers. Examples of pop-up sprinklers are found in U.S. Pat. Nos. 5,288,022; 5,058,806; 4,834,289; 4,815,662; and 4,790,481.

Commonly owned U.S. Pat. Nos. 6,651,905 and 6,736,332 (both of which are incorporated in their entirety herein by reference) disclose sprinkler heads designed especially (but not exclusively) for use with pop-up type sprinklers configurations, and that provide within limits, essentially infinite arc adjustment and throw radius adjustment features, and at the same time, constant precipitation rates and good uniformity. These sprinklers also minimize suckback plugging of the nozzle; permit active cleaning of the nozzle, and minimize potential damage to critical internal components when, for example, impacted during use.

The sprinkler heads in the '905 and '332 patents generally include a nozzle and a rotary water distribution plate (or rotor plate) mounted on a shaft so as to be axially spaced from the nozzle. The rotor plate is formed with a plurality of curved, generally radial grooves that cause the rotor plate to rotate when impinged upon by a hollow, generally cone-shaped stream emitted from the nozzle. The rotor plate may incorporate a viscous damping mechanism to slow its rate of rotation.

In the pop-up embodiments, the nozzle and associated stream deflector are supported within a hollow stem which, in turn, is supported within a cylindrical base. A coil spring is located axially between a flange at the upper end of the stem and an arc adjustment ring at the upper end of the base. This coil spring biases the rotor plate, shaft, nozzle, deflector and stem to a retracted position relative to the base.

The shaft on which the rotor plate is mounted extends downwardly into and through the deflector, and is provided with an externally threaded metal sleeve fixed to the lower end of the shaft. A throttle member is threadably mounted on the fixed sleeve, so that rotation of the shaft will result in the throttle member moving axially upwardly or downwardly on the shaft, depending on the direction of rotation of the shaft, toward or away from a flow-restriction stop formed near the lower end of the stem. In this way, flow rate to the nozzle, and hence throw radius, can be adjusted as desired. A "slip clutch" mechanism is also provided to protect the throttle assembly in the event of over-rotation of the shaft. Preferably, the arrangement is such that the flow cannot be completely shut off. In other words, even in a position where the throttle member is moved to its maximum restrictive position, enough water is permitted to flow through the base to the nozzle so that the rotor plate continues to rotate, albeit at a slower speed. This preferred configuration is intended to prevent stalling, a condition where the rotor plate ceases rotation as water pressure drops. The throw radius adjustment is effected by rotation of the shaft by a suitable tool engageable with an end of the shaft that is externally accessible to the user. Aside from the flow rate or throw radius adjustment function, the shaft is otherwise rotationally stationary during normal operation, i.e., the rotor plate rotates about the shaft.

In accordance with the '332 patent, the throttle member may be constructed of a suitable urethane rubber and preferably a polyurethane thermoplastic elastomer. Using this material, the interior surface of the throttle member may be left smooth when manufactured, but will resiliently self-tap when engaged by the externally threaded metal sleeve fixed to the lower end of the shaft. This arrangement is particularly advantageous in that, in the event the shaft is over-rotated, the elastomeric throttle member will simply slip over the thread on the metal sleeve, thus creating an effective "slip clutch" that prevents damage to the stem assembly.

In the '332 and '905 patents, the nozzle is rotatably mounted within the base, and cooperates with a stream deflector mounted on the shaft to define an arcuate water discharge orifice. The nozzle is operatively connected through a drive mechanism to the arc adjustment ring mounted on the top of the base, and externally accessible to the user. Thus, the user may rotate the arc adjustment ring to lengthen or shorten the arcuate length of the discharge orifice. It is disclosed that a pair of nozzle/deflector combinations may be employed to provide adjustable arcs between 90° and 210°, and between 210° and 270°. In accordance with another embodiment, the nozzle and deflector are further modified to provide a 360° or full circle pattern.

The arc adjustment feature can be utilized in a pop-up sprinkler only when the rotor plate is extended relative to the base. In other words, components of the drive mechanism are fully engaged only when the nozzle, deflector and stem move upwardly with the rotor plate to engage complementary drive components on the arc adjustment ring. This arrangement prevents accidental arc adjustment when the sprinkler is not in use, e.g., through contact with a lawn mower, weed trimmer or the like. In addition, the arc adjustment ring is configured to permit re-orientation of the sprinkler pattern after the sprinkler is secured to, for example, a fixed, non-rotatable stem or riser in a pop-up assembly.

When used in a pop-up type sprinkler, the sprinklers disclosed in the '332 and '905 patents are extended by a two-stage pop-up mechanism. First, the extendable tube of the pop-up assembly will extend as water under pressure is introduced into the assembly. After the tube extends out of the fixed riser, the rotor plate, nozzle, deflector and stem extend further away from the base at the distal end of the extendable tube so that water emitted from the nozzle can be distributed radially by the rotor plate. This two-stage action is reversed when the flow of water is shut off, so that the rotor plate is in a retracted position that prevents any foreign matter from entering into the nozzle area before the extendable tube of the pop-up assembly is retracted.

SUMMARY OF THE INVENTION

In accordance with this invention, the stream deflector component of the deflector/nozzle assembly as disclosed in the '332 and '905 patents is modified to produce a wetted area or pattern that is long and narrow (i.e., substantially rectangular) rather than the traditional circular or part-circular patterns).

It is understood that the nozzle orifice (where the water stream emits to atmosphere) as disclosed in the '332 and '905 patents, is in the form of an arcuate slot defined by cooperating geometry of the deflector and nozzle components. By modifying the deflector, as described herein, it is possible to shape the water stream upstream of the water distribution or rotor plate such that it will interact with the latter to achieve the desired rectangular-shaped wetted pattern area.

More specifically, modification of the stream deflector helps to create a nozzle orifice that is separated into three sections, each section designed to water a different portion of the desired rectangular pattern area. Two of the sections (i.e., two side sections at opposite ends of the rectangular pattern) are formed in part by two normal, arcuate slots, but of shortened arcuate length, provided in a horizontal wall surface of the deflector, with unrestricted water passages supplying water to these side slots, and with unmodified, cone-shaped surfaces of the stream deflector creating, in combination with the nozzle, a normal hollow, cone-shaped full-energy stream in these two side sections. A third arcuate slot, located between the two side slots, is supplied with water via restrictive ports upstream of the orifice, in the same horizontal wall surface of the deflector, that reduce energy in the stream. In addition, the cone-shaped surface of the stream deflector, downstream of the third arcuate slot, is modified to include a projecting boss that, in combination with the nozzle, re-shapes the low-energy stream for interaction with the rotary distributor to properly fill in the middle area or section between the first two side sections. In this regard, the deflector boss is shaped to create a stream that throws only a very short distance in front of the sprinkler, gradually increasing in distance of throw on both sides of this frontal area.

Another feature of this modified design allows for some adjustability along one side edge of the substantially rectangular-shaped wetted pattern area that, in effect, enlarges one end of the otherwise rectangular pattern.

Still another feature of the modified design is that the throttle can be used to reduce the size of the area watered while the length and width of the pattern is kept generally proportional.

In a related embodiment, it is possible to provide complimentary "end units" at opposite ends of the rectangular pattern area by blocking one or the other of the two side section orifices, and the adjacent half of the middle section.

Accordingly, in one aspect, the invention relates to a rotary sprinkler comprising a sprinkler body supporting a nozzle body and a water distribution plate supported on a shaft downstream of the nozzle body, the water distribution plate provided with a plurality of grooves shaped to redirect a stream emitted from the nozzle body and to cause the water distribution plate to rotate when struck by the stream, the nozzle body having an arcuate edge partially defining plural discharge orifices; a stream deflector supported within the sprinkler body and surrounded by the nozzle body; wherein the stream deflector is configured to cooperate with the arcuate edge to produce a substantially rectangular pattern.

In another aspect, the invention relates to a rotary sprinkler comprising a sprinkler body supporting a nozzle body and a water distribution plate supported on a shaft downstream of the nozzle body, the water distribution plate provided with a plurality of grooves shaped to redirect a stream emitted from the nozzle body and to cause the water distribution plate to rotate when struck by the stream, the nozzle body having an arcuate edge partially defining plural discharge orifices; and means for shaping a stream emitted from the nozzle body to produce a rectangular pattern.

In yet another aspect, the invention relates to a deflector for a sprinkler having a nozzle body formed with an arcuate edge that partially defines plural discharge orifices, the deflector comprising a center hub extending upwardly through an annular ring closed at an upper end thereof by a substantially horizontal surface, the center hub having an arcuate stream-engaging surface at an upper end thereof adapted to cooperate with the arcuate edge of the nozzle to form the plural discharge orifices; a pair of vertical, arcuately spaced ribs on the center hub extending upwardly from the horizontal surface for partially defining a first of the plural discharge orifices; an upstanding tab proximate one of the pair of ribs such that the one of the pair of ribs and the upstanding tab partially define a second of the plural discharge orifices, and wherein the outer of the pair of ribs partially defines a third of the plural discharge orifices; a first substantially arcuate slot formed in the horizontal surface between the one of the pair of ribs and the upstanding tab, and a second substantially arcuate slot formed in the horizontal surface adjacent the other of the pair of tabs; and at least one flow port formed in the horizontal surface between the pair of ribs.

In still another aspect, the invention relates to a rotary sprinkler comprising a sprinkler body supporting a nozzle body and a water distribution plate supported on a shaft downstream of the nozzle body, the water distribution plate provided with a plurality of grooves shaped to redirect a stream emitted from the nozzle body and to cause the water distribution plate to rotate when struck by the stream, the nozzle body having an edge partially defining plural discharge orifices; a stream deflector supported within the sprinkler body and surrounded by the nozzle body; wherein the stream deflector is configured to cooperate with the edge to produce a substantially rectangular pattern, the deflector provided at least one port for restricting flow to one of the plural discharge orifices.

The invention will now be described in detail in connection with the drawings identified below.

DETAILED DESCRIPTION OF THE DRAWINGS

Figure 1:
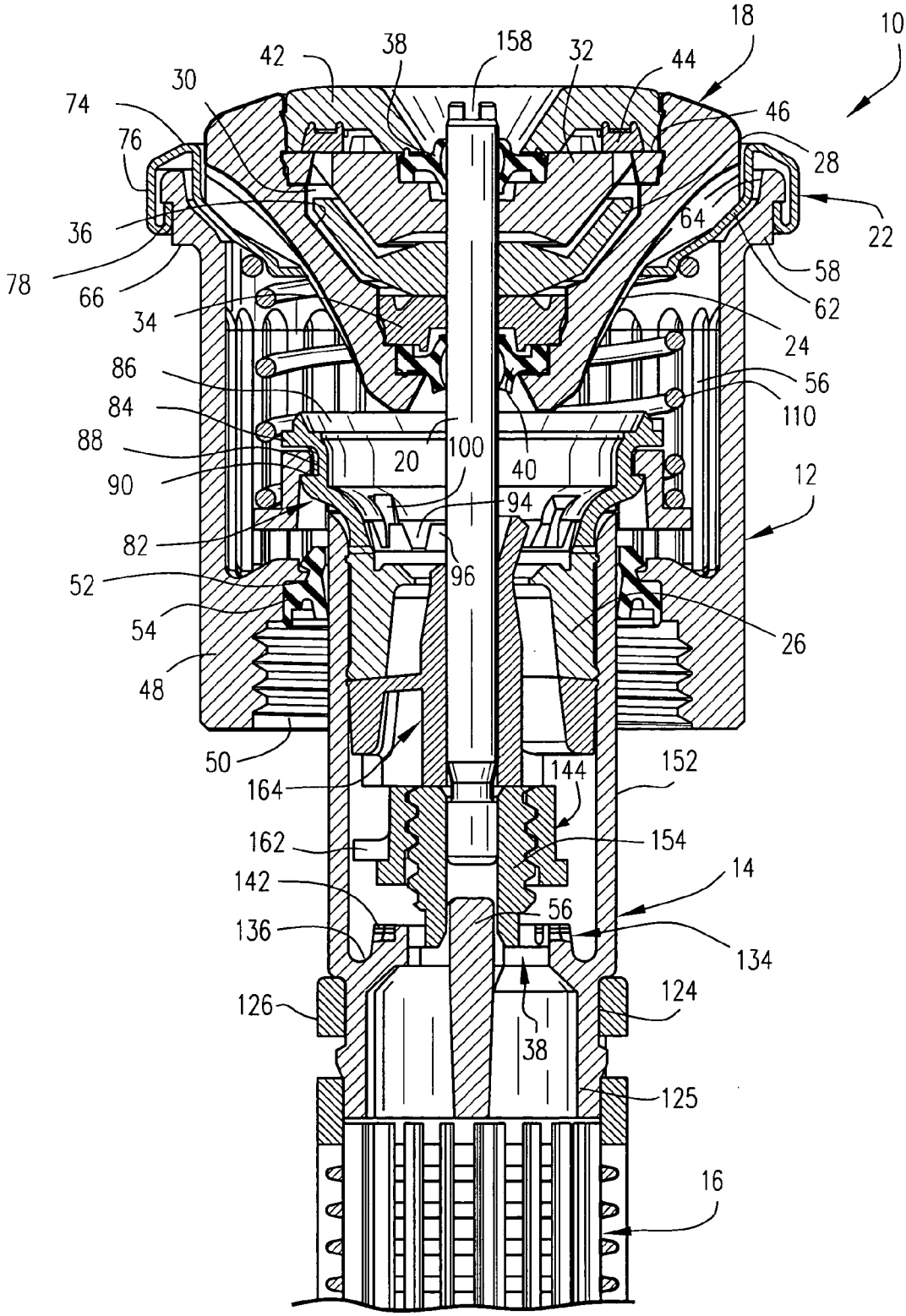
FIG. 1 is a cross sectional view of a sprinkler head in accordance with an embodiment of the invention.
Figure 2:
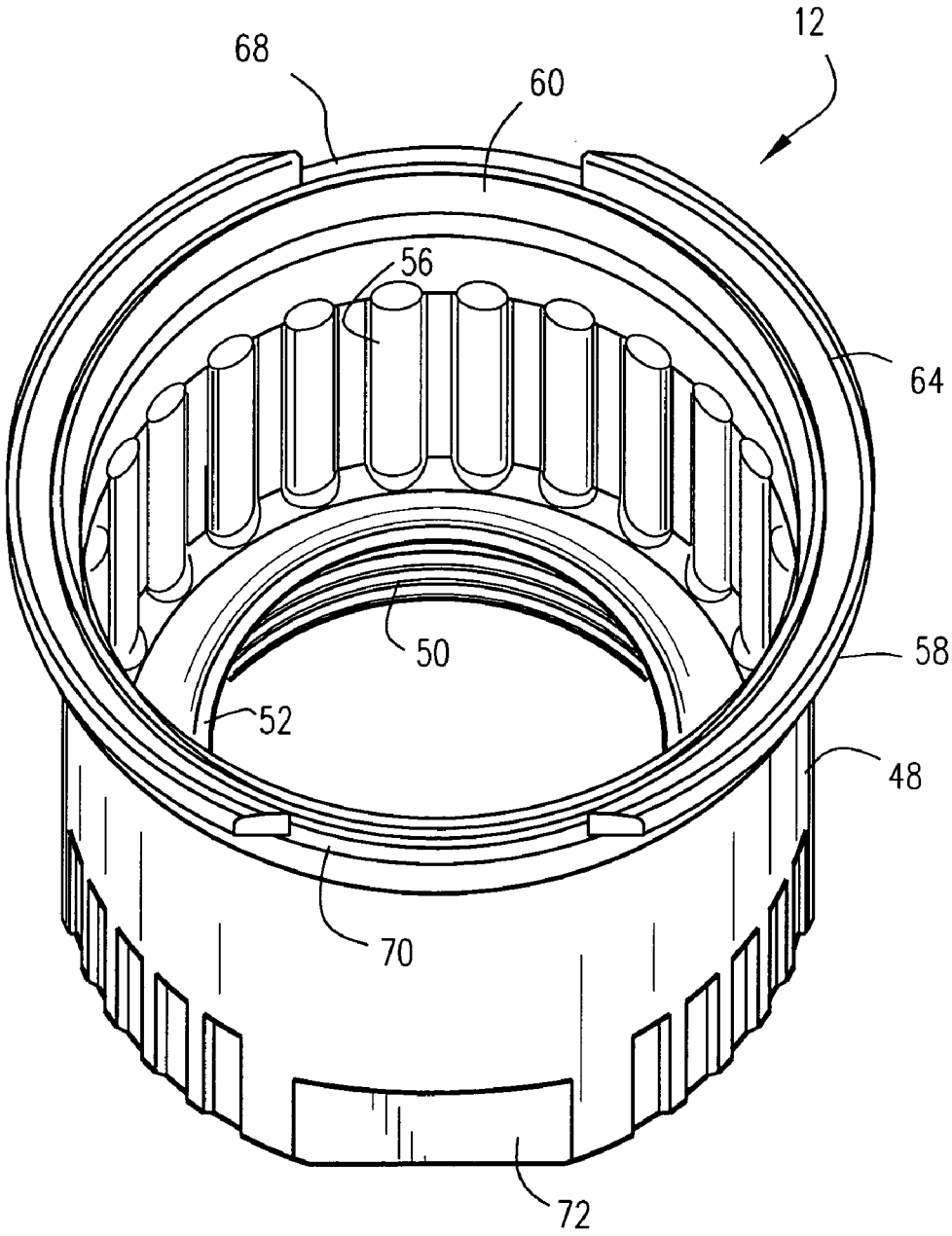
FIG. 2 is a perspective view of a base element of the sprinkler head in FIG. 1.
Figure 3:
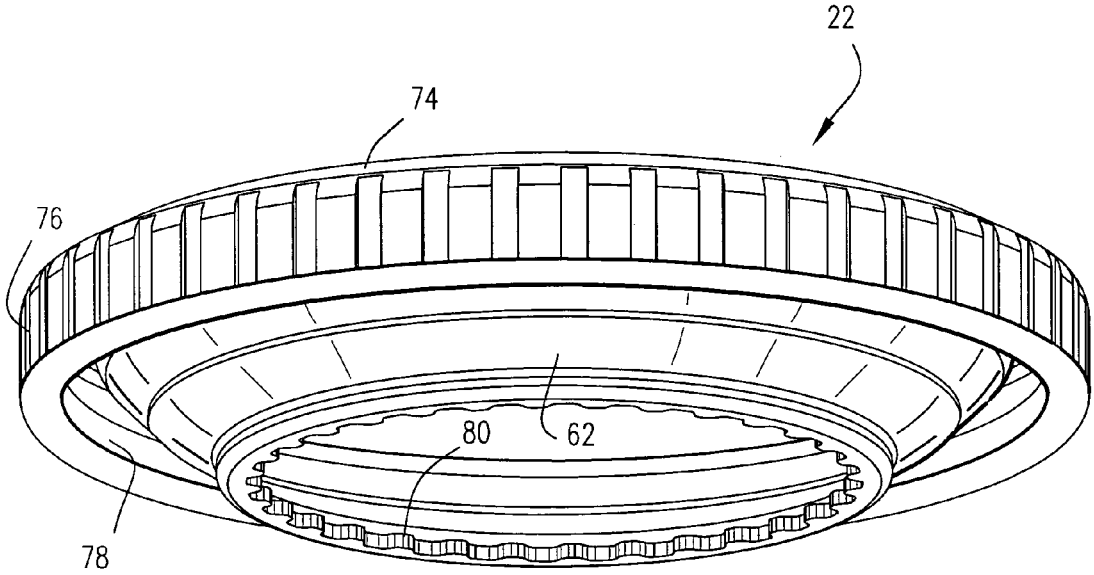
FIG. 3 is a perspective view of an arc adjustment control ring from FIG. 1.

With reference initially to FIG. 1-16, the sprinkler head 10 generally includes a base or housing 12 and a stem 14, with a conventional filter 16 attached to the lower end of the stem. The base 12 is adapted to be threadably attached to a pressurized water source. A water distribution plate 18 (or "rotor plate") is mounted to the base 12, via a flow rate or throttle adjustment shaft 20 that extends between the plate 18 and the stem. A rotatable arc adjustment ring 22 is secured to the top of the base 12.

The rotor plate 18 is mounted for rotation relative to the normally stationary shaft 20. Externally, the rotor plate 18 is formed with a series of generally radially oriented water distribution grooves 24. The grooves 24 have lowermost entrance points that are preferably radially spaced from the shaft 20 in order to catch and distribute the arcuate (or annular) stream emanating from the nozzle 26. The grooves are also curved in a circumferential direction, causing the rotor plate to rotate about the shaft 20 when impinged upon by the stream.

The rotational speed of the rotor plate 18 may be slowed by a viscous dampening mechanism or "motor" (or "viscous retarder") that includes a generally cup-shaped stator 28 fixed to the shaft 20. The stator is located in a chamber 30 defined by upper and lower bearings 32, 34 as well as the interior surface 36 of the hollow rotor plate 18. The chamber 30 is filled or partially filled with a viscous fluid (preferably a silicone fluid) that exhibits viscous shear as the rotor plate 18 rotates relative to the fixed stator 28, significantly slowing the rotational speed of the rotor plate as compared to a rotational speed that would be achieved without viscous dampening. The viscous shearing action is enhanced by the shape of the upper bearing 32, the lower portion of which fits within, but remains spaced from, the cup-shaped stator 28.

Upper and lower annular seals 38, 40 are mounted on the shaft 20 to prevent leakage of silicone fluid out of the chamber 30. A cap or retainer 42 is press fit into the plate 18, with a seal ring 44 engaging an upper surface 46 of the upper bearing 32 to provide additional sealing of chamber 30.

The base 12 (FIGS. 1 and 2) includes a substantially cylindrical sleeve-like member 48 that is formed with an internally threaded inlet 50 by which the sprinkler head 10 may be attached to, for example, a conventional pop-up assembly or other sprinkler component. The inlet 50 also includes a radially in-turned edge 52 that serves as an annular seat for a flexible seal 54. A substantial portion of the base 12 is formed on its interior surface with a plurality (for example, 24) of circumferentially spaced, axially extending ribs or flutes 56. The upper end of the base 12 is diametrically enlarged via a radial flange 58 that includes a radially outwardly and upwardly tapered surface 60 (FIG. 2) that serves as a seat for a similarly tapered surface 62 (FIG. 1) on the arc adjustment ring 22 when the rotor plate 18 is in the retracted, inoperative position shown in FIG. 1.

Surface 60 merges with a less sharply tapered rim 64 that has an undercut on its outer side to facilitate retention of the arc adjustment ring 22. A radial shoulder 66 is adapted to engage an annular surface on the pop-up sprinkler body (not shown). As explained further below, the axially extending internal ribs or flutes 56 on the base 12 are utilized to normally prevent rotation of the stem 14 relative to the base 12, but to permit such rotation upon the application of torque to the arc adjustment ring 22 over and above that required to adjust the pattern arc (also referred to herein as a "click adjust" feature, described in great detail below), in order to properly orient the pattern itself. Discontinuities or cut-outs 68, 70 in the rim 64 and flat 72 at the lower end of the base (FIG. 2) are provided for orienting the base during assembly.

The arc adjustment ring 22 (FIGS. 1 and 3) includes an upper radially outturned rim 74 that is adapted to fit over the upper rim 64 of the base 12. Rim 74 includes a depending skirt 76 that forms the outer diameter of the ring 22. The lower end of skirt 76 is provided with a radially in-turned curl 78 engaged in the undercut below rim 64 such that the arc adjustment ring 22 is rotatable, but otherwise axially fixed relative to the base 12. The previously described tapered surface 62 extends downwardly and inwardly to an annular row of radially inwardly facing (or horizontally projecting) gear teeth 80 (FIG. 3) that are used in the implementation of the arc adjustment capability as described further below.

Figure 4:
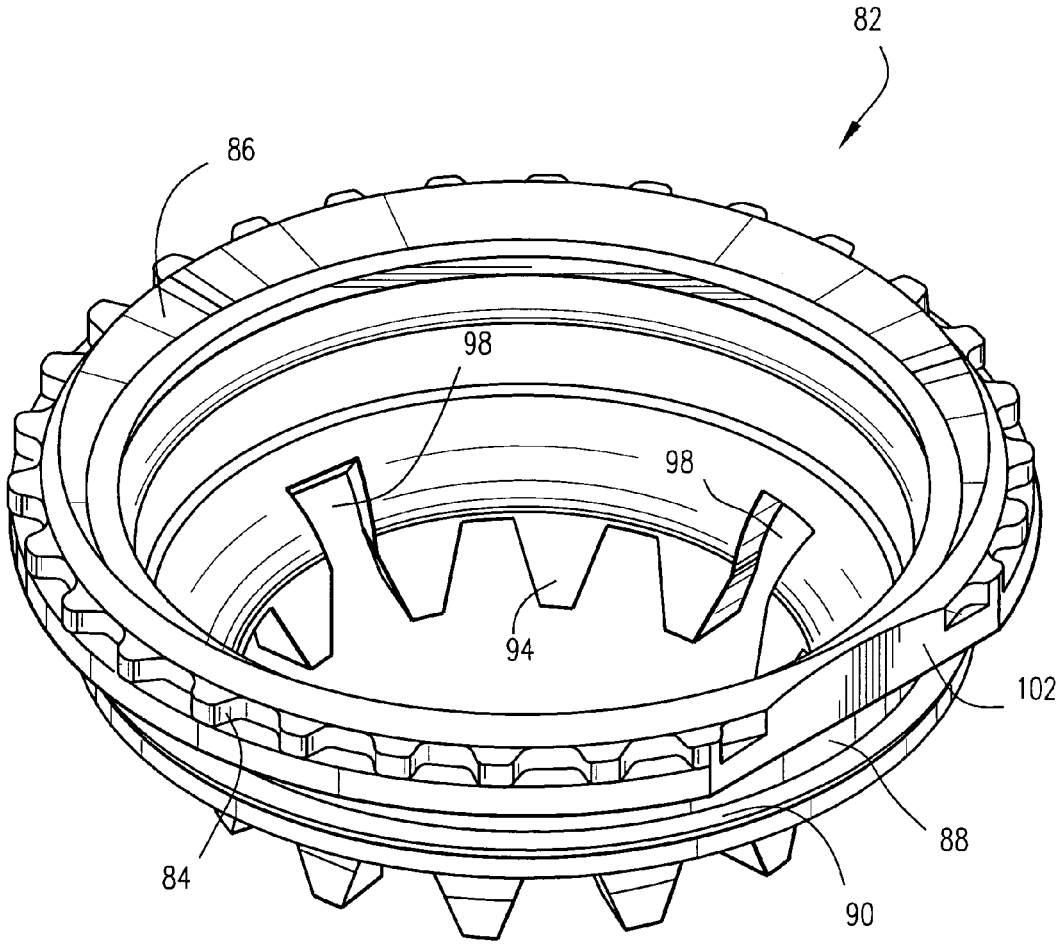
FIG. 4 is a perspective view of a drive ring taken from the sprinkler head illustrated in FIG. 1.
Figure 5:
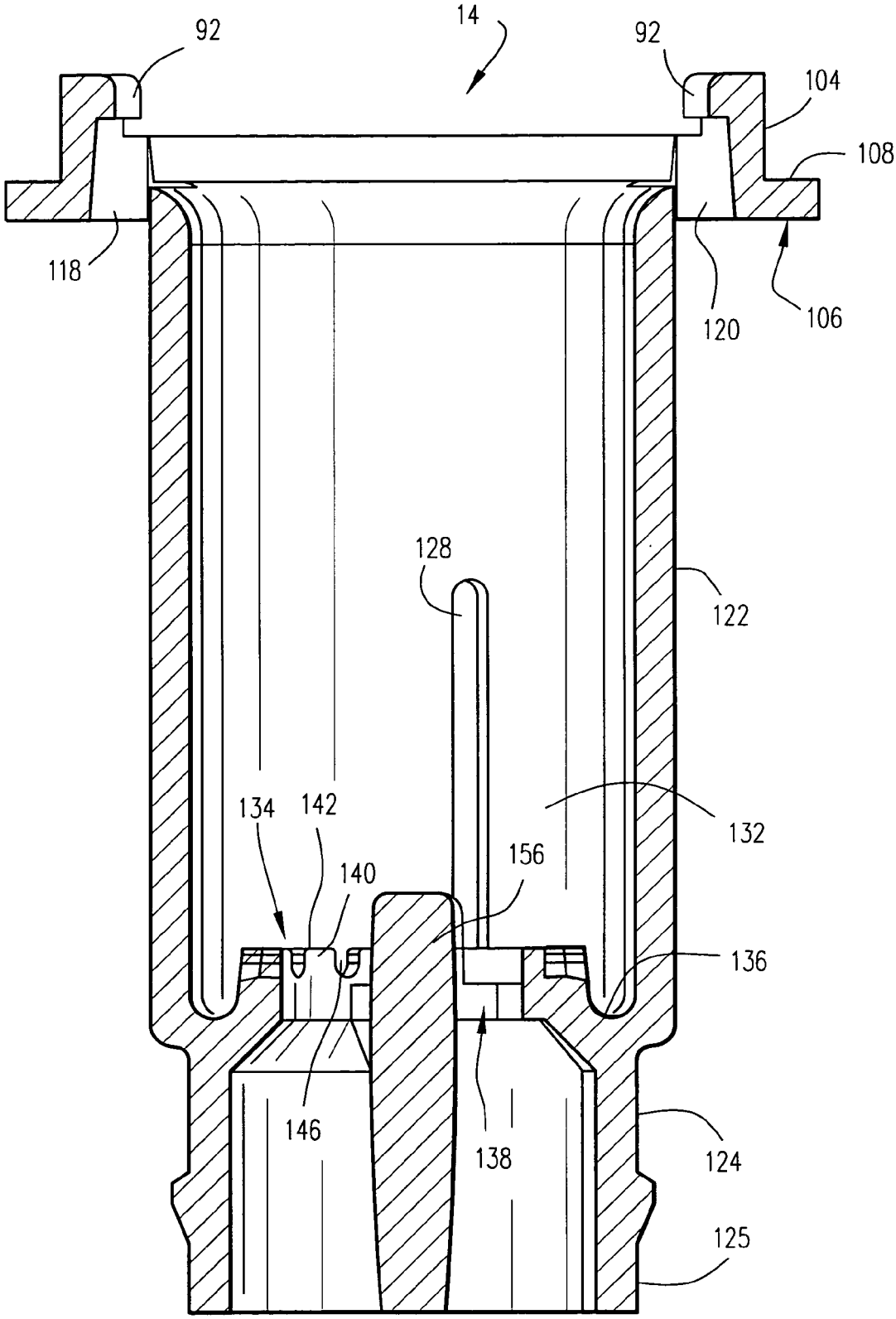
FIG. 5 is a cross sectional view of a stem component taken from the sprinkler head illustrated in FIG. 1.
Figure 6:
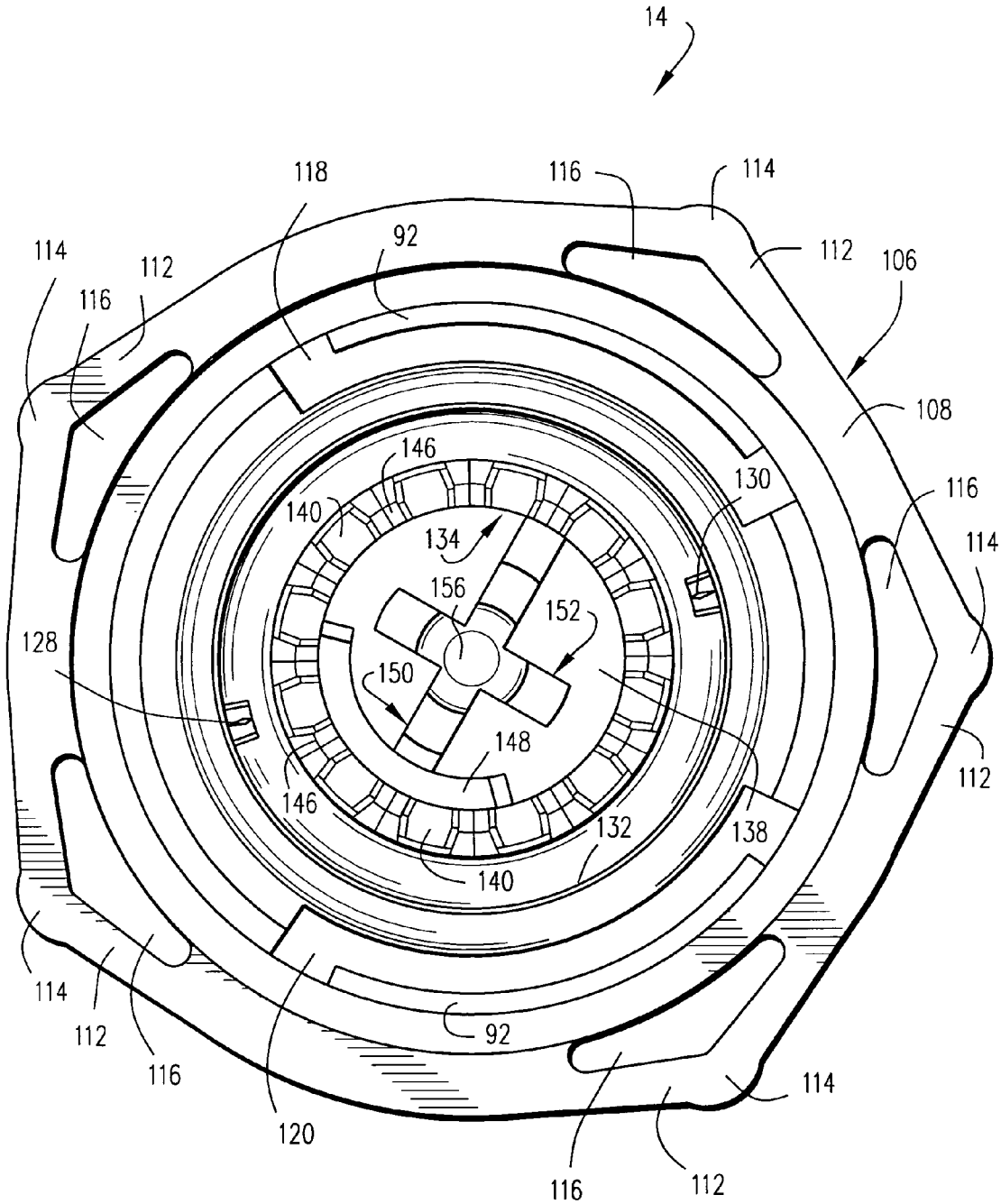
FIG. 6 is a top plan view of the stem shown in FIG. 5.
Figure 7:
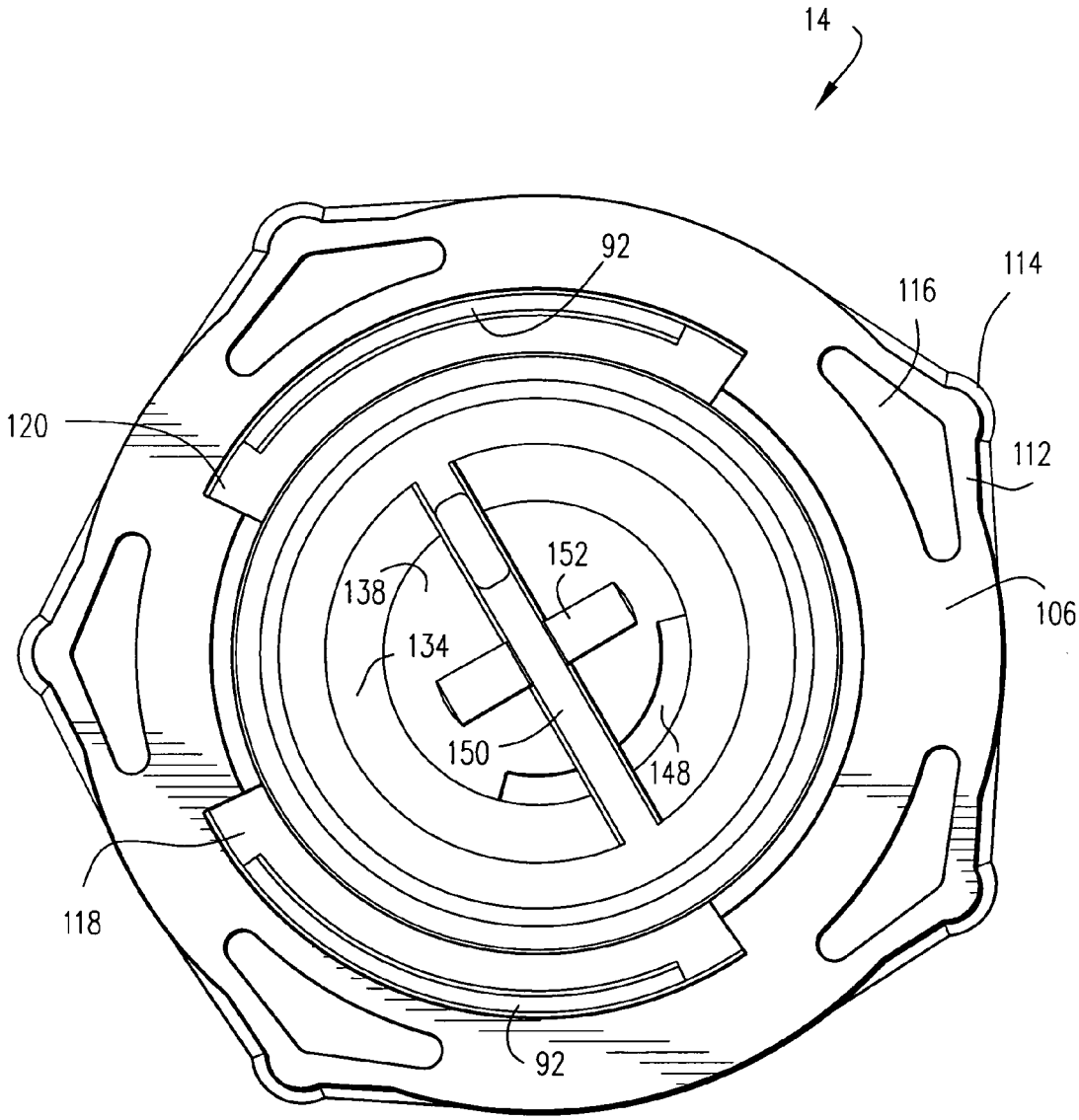
FIG. 7 is a bottom plan view of the stem illustrated in FIG. 5.
Figure 8:
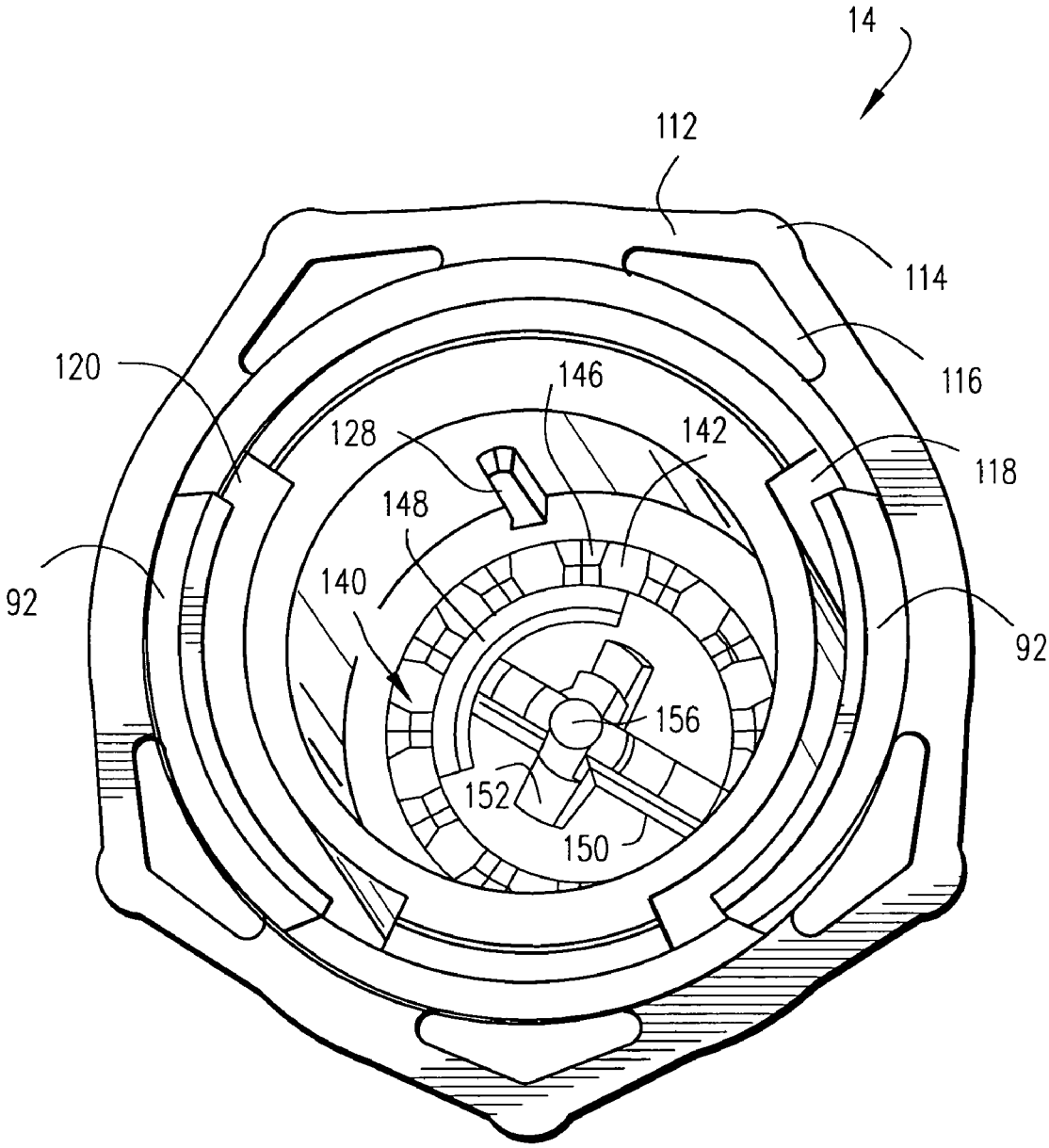
FIG. 8 is a perspective view of the stem shown in FIG. 5.

With reference now to FIG. 4, and with continuing reference to FIG. 1, an arc adjustment actuator or drive ring 82 is axially interposed between the arc adjustment ring 22 and the nozzle 26. The drive ring 82 is formed with a first radially outwardly facing annular row of teeth 84 that are adjacent and below a conically-shaped upper rim 86. An annular undercut or groove 88 on the outer surface of the ring provides a seat or shoulder 90 adapted to receive radially inwardly directed ribs 92 (FIGS. 5, 6) on the stem 14. A second annular row of teeth 94 (FIGS. 1 and 4) project downwardly from the lower end of the ring, spaced radially inwardly of the upper row of teeth 84.

The upper horizontally-oriented row of teeth 84 are adapted to mesh with the row of teeth 80 on the arc adjustment ring 22, but only when the rotor plate 18 and stem 14 are extended relative to the base. The lower vertically oriented row of teeth 94 is adapted to always mesh with an upper row of teeth 96 on the nozzle 26 as described further below. Just below the annular seat 88 are four, circumferentially equally spaced windows 98 (FIG. 4) that are located directly above corresponding ones of the teeth 96 on the nozzle. In other words, these windows 98 are, in fact, extensions of the spaces between the lower row of teeth 94. Two of the spaces or windows 98 are adapted to receive two corresponding tabs 100 that extend upwardly from a pair of diametrically opposed teeth 96 on the nozzle 26 (see FIGS. 1, 4 and 15). These tabs 100 and windows or recesses 98 assure correct orientation of the drive ring 82 relative to the nozzle 26.

A vertical rib (not shown) in the groove 88 limits rotation of the ring 22 and nozzle 26 by engaging a selected edge of one of the radially inwardly directed ribs 92. As will be explained further below, this rib limits the rotation of the nozzle 26. Because the position of the limiting rib on the drive ring 82 is thus related to the nozzle orifice, it will be appreciated that the nozzle and drive ring must be properly oriented on assembly. Thus, for a nozzle with adjustability through a range of 90°-210°, the tabs 100 on the nozzle will seat in one pair of windows 98 while for a nozzle with a greater range, e.g., up to 270°, the tabs 100 will seat in the other pair of windows 98. This arrangement permits one drive ring configuration to be used with different nozzles. The flat 102 at the upper end of the drive ring (see FIG. 4) also facilitates automated assembly with the stem 14.

FIGS. 5-8 illustrate the stem 14 in further detail. This stem is formed at its upper end with the above-mentioned pair of circumferentially spaced, radially inwardly directed, arcuate ribs 92. These ribs extend from an outer cylindrical wall 104 that extends downwardly to a radial flange 106 that provides a seating surface 108 for a coil spring 110. The flange 106 includes a plurality of circumferentially spaced, laterally extending spring tabs 112 that are unequally spaced about the flange 106. Specifically, the spring tabs 112 and five associated rounded tips 114 are spaced to insure that each of the tips 114 will be seated between respective pairs of the twenty-four flutes 56 in the base 12. As further described below, it is the interaction of spring tabs 112 with the flutes 16 that permits the sprinkling pattern to be reoriented even though the sprinkler head is attached to a fixed riser or other sprinkler component. In this regard, the openings 116 adjacent the spring tabs allow the latter to flex as they rotate past the flutes 56 on the base during pattern reorientation, while allowing the stem per se to remain rigid.

In order to form the arcuate, radially inwardly directed ribs 92, slots 118, 120 are formed at the root of the corresponding flange 106, thus permitting access by forming tools during manufacture.

Below flange 106, the stem 14 is made up of a substantially cylindrical tubular portion 122, with a lower end having an annular groove 124 and a reduced diameter inlet portion 125. Groove 124 is adapted to receive an upper end 126 of the filter 16 (FIG. 1) in snap-fit relationship. Interiorly, the tubular portion 122 is formed with a pair of diametrically opposed, axially extending ribs 128, 130, extending radially inwardly from the interior surface 132 of the tubular portion 122.

Ribs 128, 130 terminate at their lower ends at a location adjacent and above the annular groove 124, where an upstanding, internal ring 134 joins to the internal surface 132 via an annular trough 136. The ring 134 thus defines a constricted opening 138 within the reduced diameter inlet portion 125 of the stem. The ring 134 is formed with a plurality of circumferentially spaced upstanding teeth 140, upper surfaces 142 of which provide a seat for the throttle control member 144. It will be appreciated that the spaces 146 between the teeth 140 permit water to pass through the inlet opening 138 and into the stem even when the throttle member is in its fully closed (or minimum flow) position, i.e., when seated on surfaces 142. This arrangement prevents stalling of the rotor plate under low flow conditions.

Note also the part-annular flow restricting flange 148 (FIGS. 6, 8) within the inlet opening 138 that serves to block some of the spaces 146 for proper throttling action on models with lower flow rates.

A cross-web 150 and shortened cross piece 152 (FIGS. 6-8), provide a seat for the throttle sleeve 154, with the raised center boss 156 extending into the hollow sleeve to maintain the shaft 20 and throttle sleeve 154 centered in the stem.

As best seen in FIG. 1, the shaft 20 extends downwardly through the nozzle 26 and through a stream deflector 164. The lower end of the shaft 20 is provided with the externally threaded throttle sleeve 154 that is pressed onto (or otherwise secured to) the shaft. The sleeve 154, preferably of metal construction, rests on the cross web 150 and shortened cross piece 152. The internally threaded throttle control member 144 is threadably received on the axially fixed sleeve 154, such that rotation of the shaft 20 causes the throttle control member 144 to move toward or away from the seating surfaces 142 of the teeth 140, depending upon the direction of the rotation of the shaft. A slot 158 at the top of the shaft 20 enables rotation of the shaft by a screw driver or similar tool.

The manner in which the throttle control member 144 moves toward or away from the seat (142) on rotation of the shaft 20 via tool slot 158 remains as described in the '332 and '905 patents. Note again that shaft 20 is stationary during normal operation, and is rotatable only to adjust the flow rate.

Figure 9:
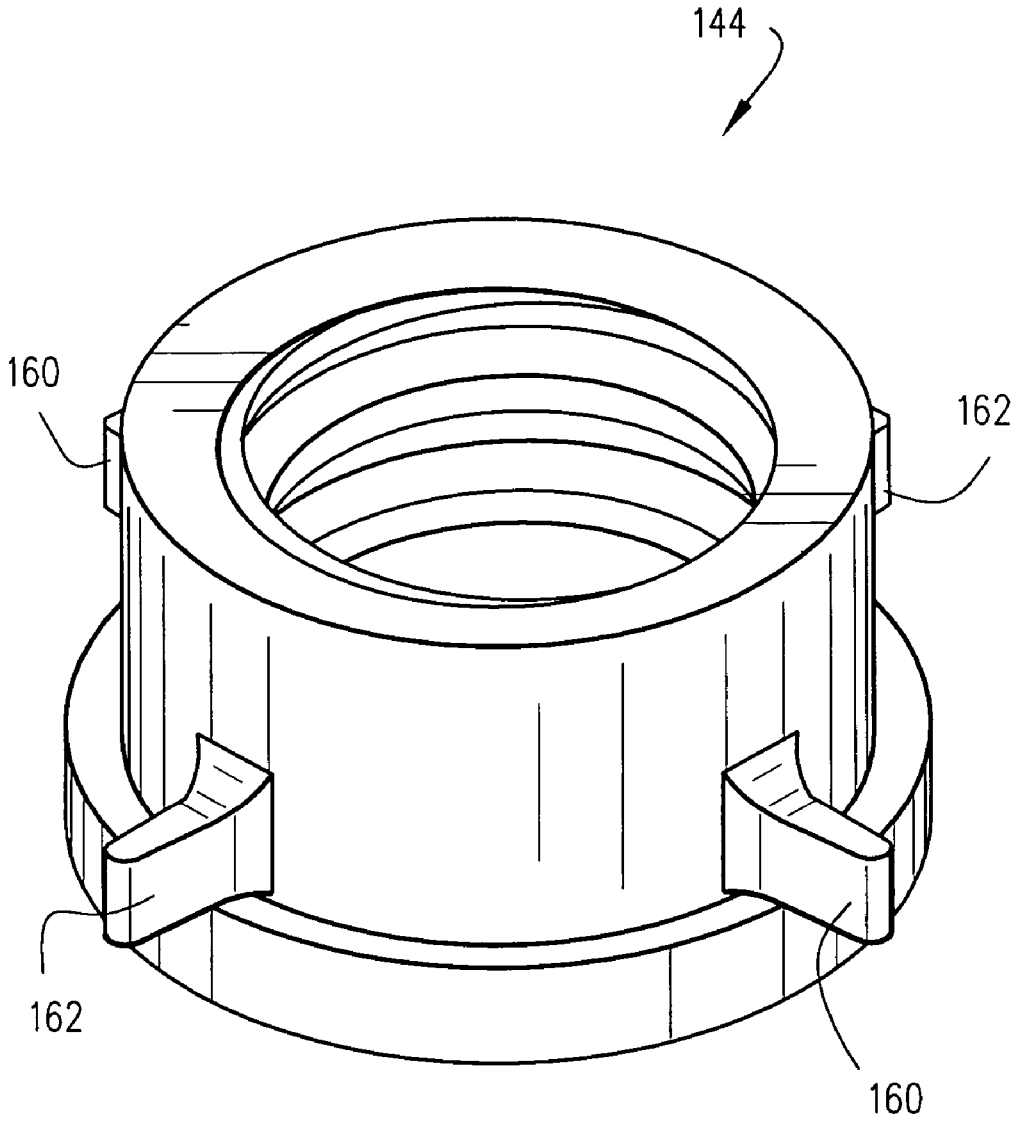
FIG. 9 is a perspective view of a throttle control member taken from the sprinkler head in FIG. 1.
Figure 10:
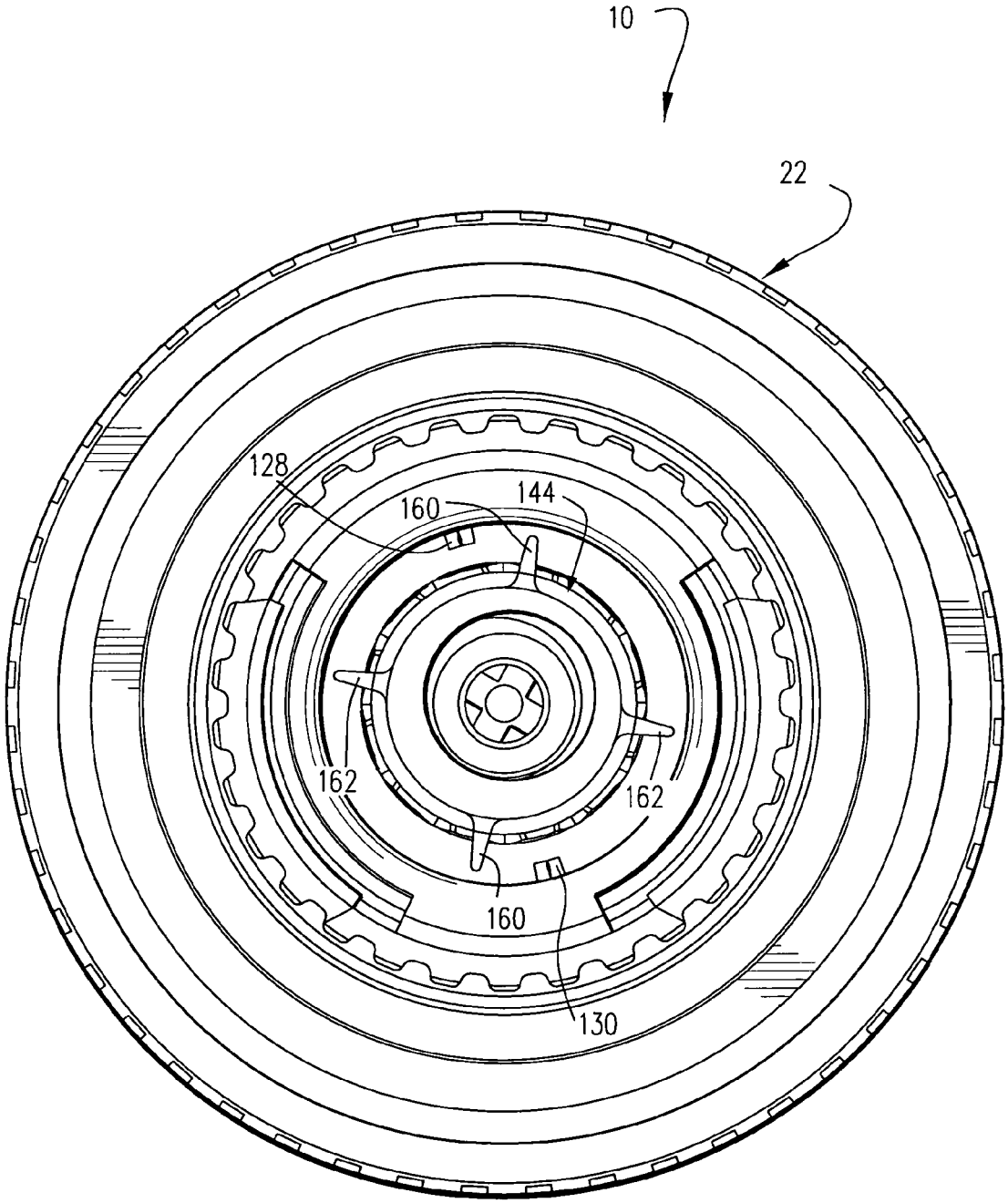
FIG. 10 is a plan view of the sprinkler head shown in FIG. 1, but with parts removed for clarity.
Figure 11:
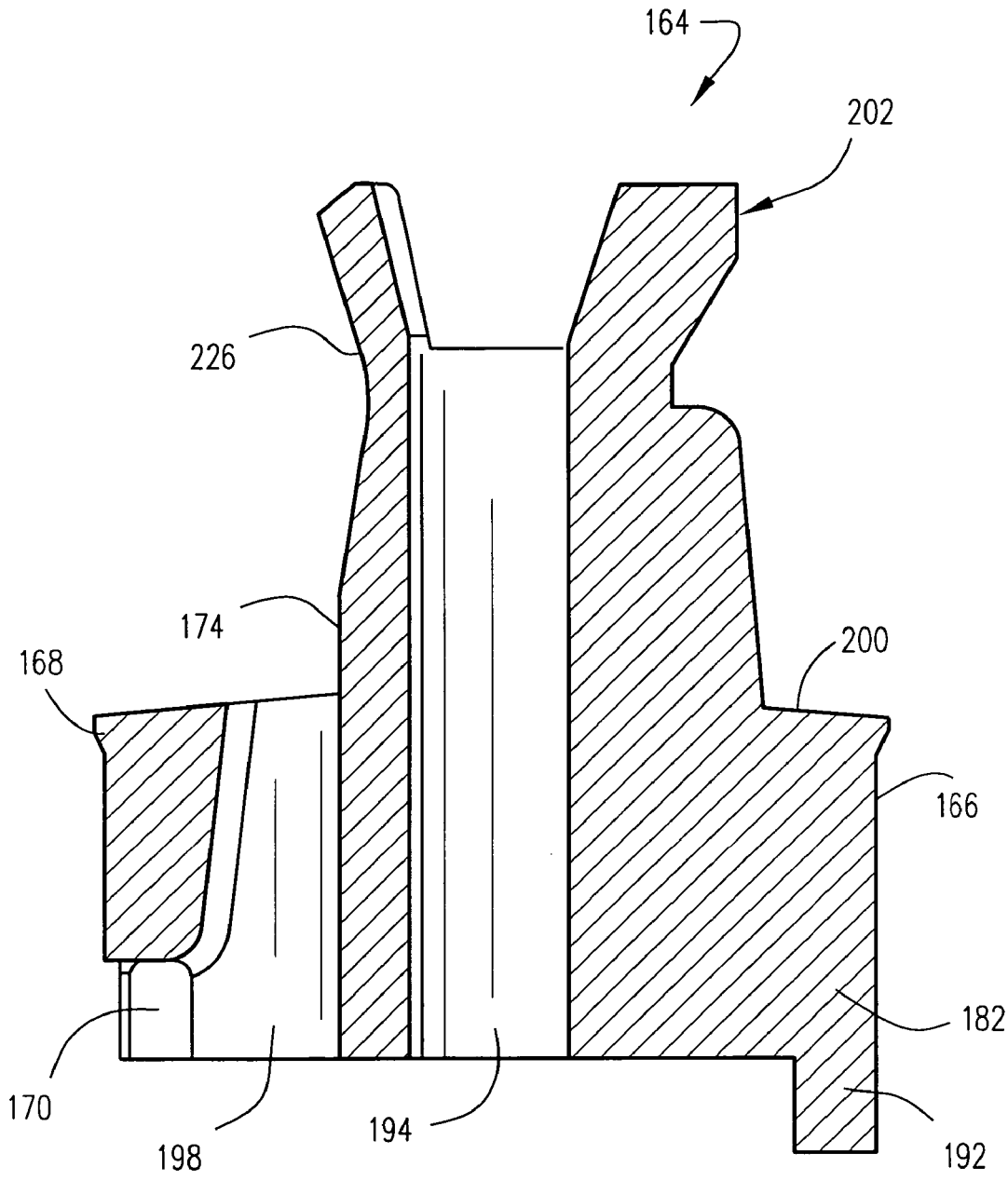
FIG. 11 is a cross section of a stream deflector component taken from FIG. 1.
Figure 12:
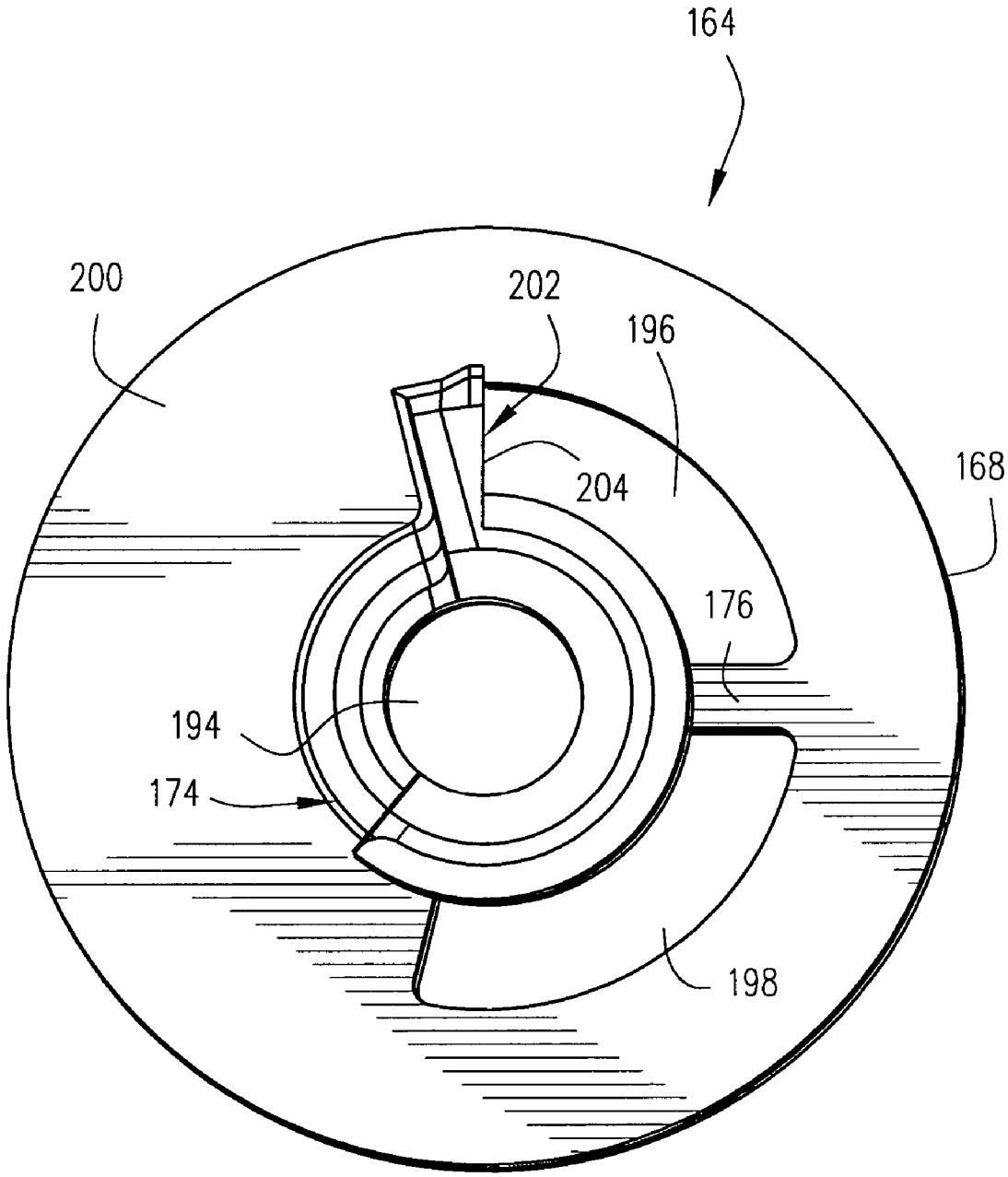
FIG. 12 is a top plan view of the stream deflector shown in FIG. 11.
Figure 13:
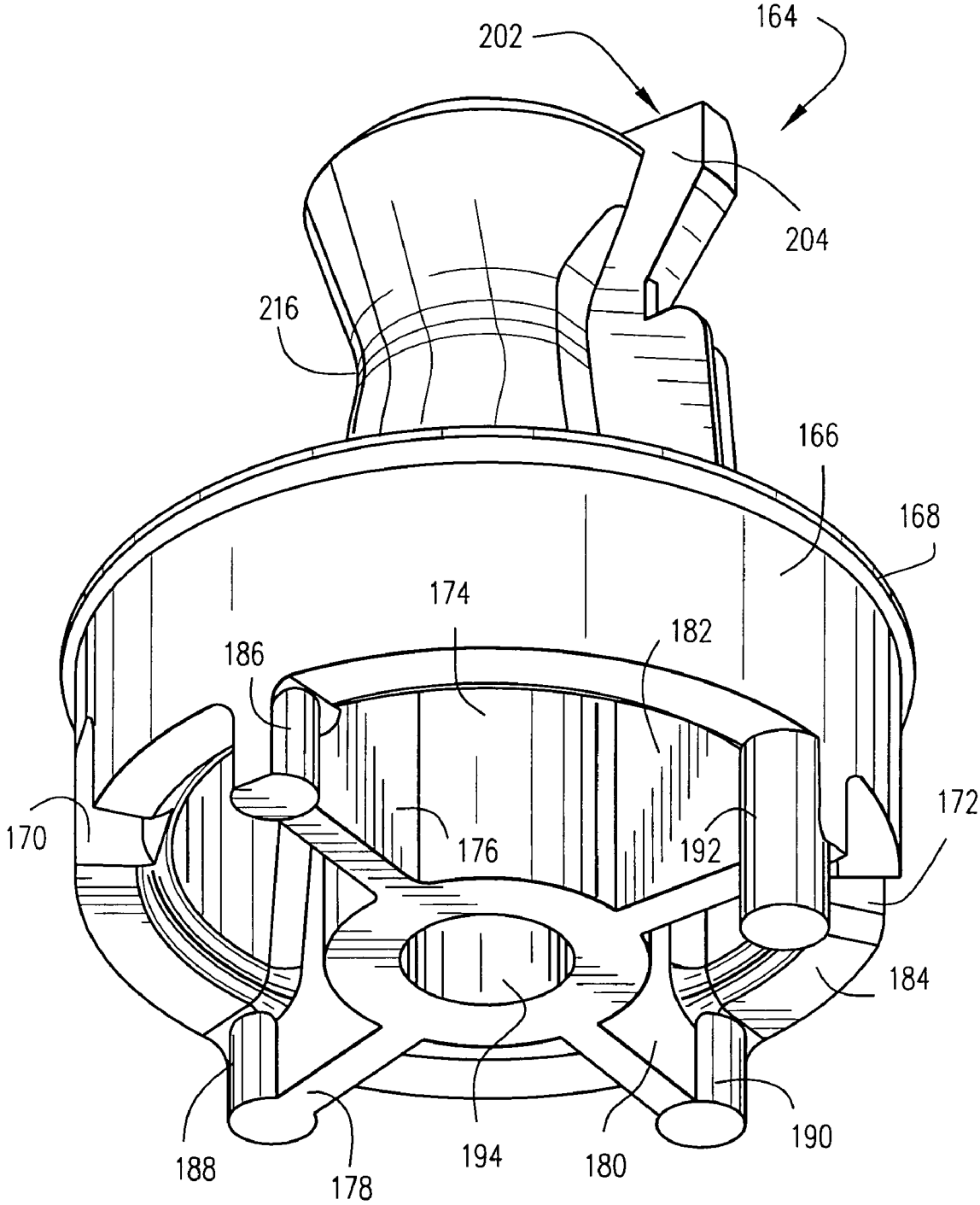
FIG. 13 is a perspective view of the stream deflector shown in FIGS. 1 and 12.
Figure 14:
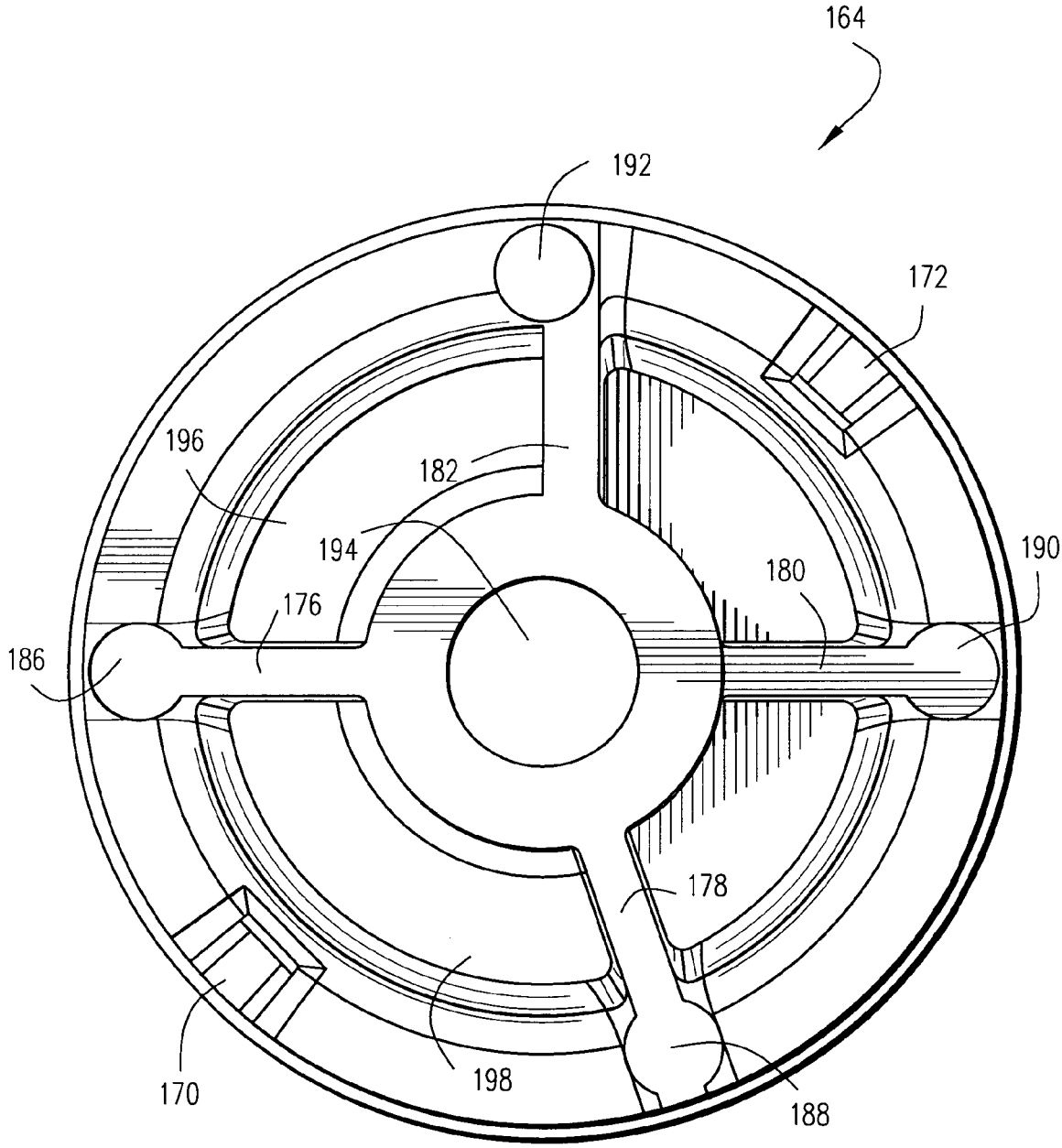
FIG. 14 is a bottom plan view of the stream deflector shown in FIG. 13.

The throttle control member 144, as best seen in FIG. 9, is formed with four, equally circumferentially spaced ears (two diametrically opposed pairs 160, 162) that, during normal operation, are located between the ribs 128, 130 as best seen in FIG. 10. It will be appreciated that rotation of the shaft 20 will initially result in rotation of both the throttle sleeve 154 and the throttle control member 144 (in either direction), until the diametrically opposed ears 160 engage ribs 128, 130 to prevent further rotation of the throttle control member, causing it to move axially due to its threaded relationship with the sleeve 154. This assumes a normal application of torque via tool slot 158 to adjust the flow rate.

It will be appreciated, however, that if excess torque is applied after the throttle control member 144 is seated on surface 142 of the teeth 140, the flexible ears 160 will permit the throttle control member 144 to rotate past the ribs 128, 130 until the other diametrically opposed pairs of ears 162 engage the ribs 128, 130. Should the application of excessive torque continue, this "slip clutch" arrangement will continue to work to prevent damage to the throttle components by permitting the throttle control member to rotate rather than move axially relative to the fixed internal components.

It will be understood that over-rotation in the throttle opening direction is handled in a similar manner, as permitted by the axial length of the ribs 128, 130.

Turning now to FIGS. 11-14, and with the continuing reference to FIG. 1, the stream deflector 164 is received within the stem 14 and cooperates with the nozzle 26 to define an arcuate water discharge orifice with an adjustable arcuate length. The stream deflector 164 also includes an annular ring or skirt portion 166 by which the deflector is secured within the stem 14. Specifically, an annular, radially outward flange 168 seals against the interior surface 132 of the stem. A mating annular groove for receiving the flange may be provided in surface 132. The skirt portion 166 of the ring is formed with a pair of notches 170, 172 (FIG. 13) that open along the bottom edge of the skirt and are adapted to receive the upper ends of the ribs 128, 130 on the interior surface 132 of the stem. This arrangement fixes the stream deflector 164 against rotation.

A center hub 174 lies at the center of the stream deflector 164 and is connected to the skirt portion 166 by a plurality of radial spokes 176, 178, 180 and 182 (FIGS. 13, 14), all of which extend below the bottom edge 184 of the skirt portion 166. Each spoke terminates at its radially outward end in a respective cylindrical stub (186, 188, 190, 192) that lies on the bottom edge 184 of the skirt portion.

Stubs 186, 188 and 190 are flush with the bottom surfaces of the respective spokes 176, 178 and 180, while stub 192 extends beyond the bottom surface of spoke 182, serving as a further locator device during automated assembly. A bore 194 extends through the stream deflector and receives the shaft 20 as shown in FIG. 1.

The stream deflector 164 is designed for use with the nozzle 26 to produce an arcuate orifice that extends to a maximum of 210°, with adjustment within the range of 90°-210°. To this end, arcuate openings 196, 198 (FIGS. 11 and 12) are formed in the surface 200, on either side of the spoke 176. Note that spoke 182 effectively extends upwardly beyond the skirt portion, forming an upstanding tab 202, with a surface 204 (FIG. 12) that forms the "fixed" edge of the nozzle discharge orifice.

Figure 15:
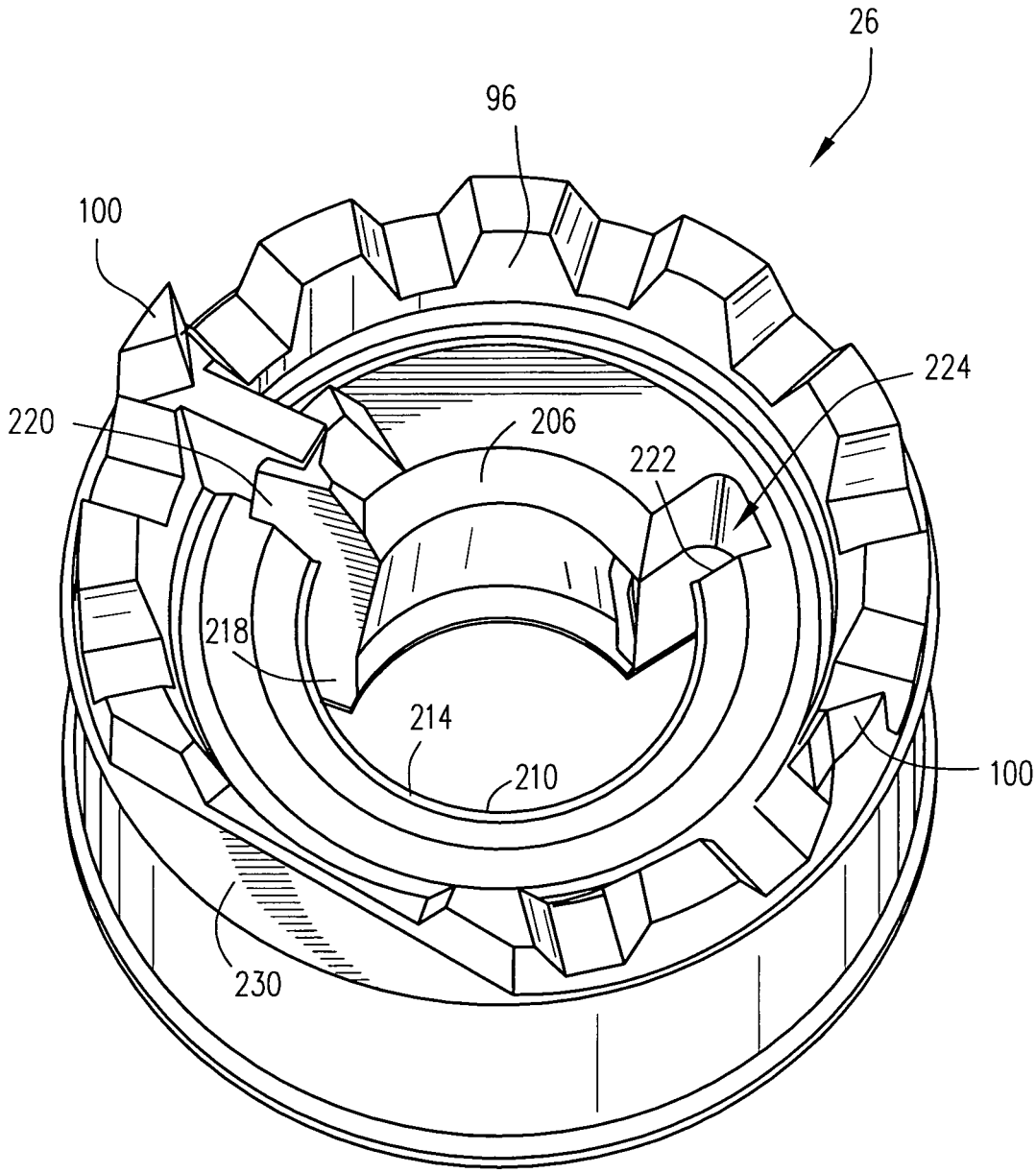
FIG. 15 is a top perspective view of a nozzle as used in FIG. 1.
Figure 16:
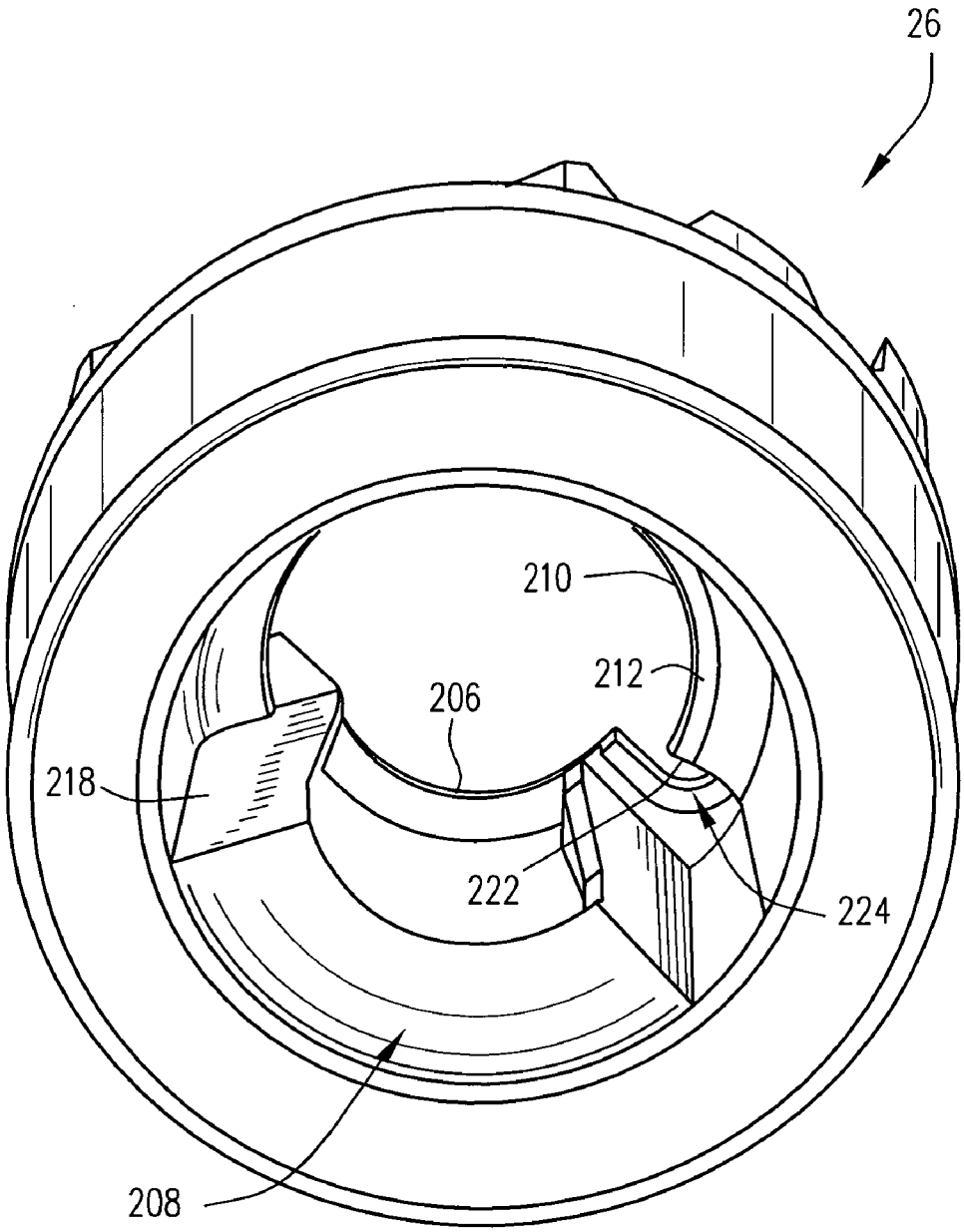
FIG. 16 is a bottom perspective view of the nozzle in FIG. 15.
Figure 17:
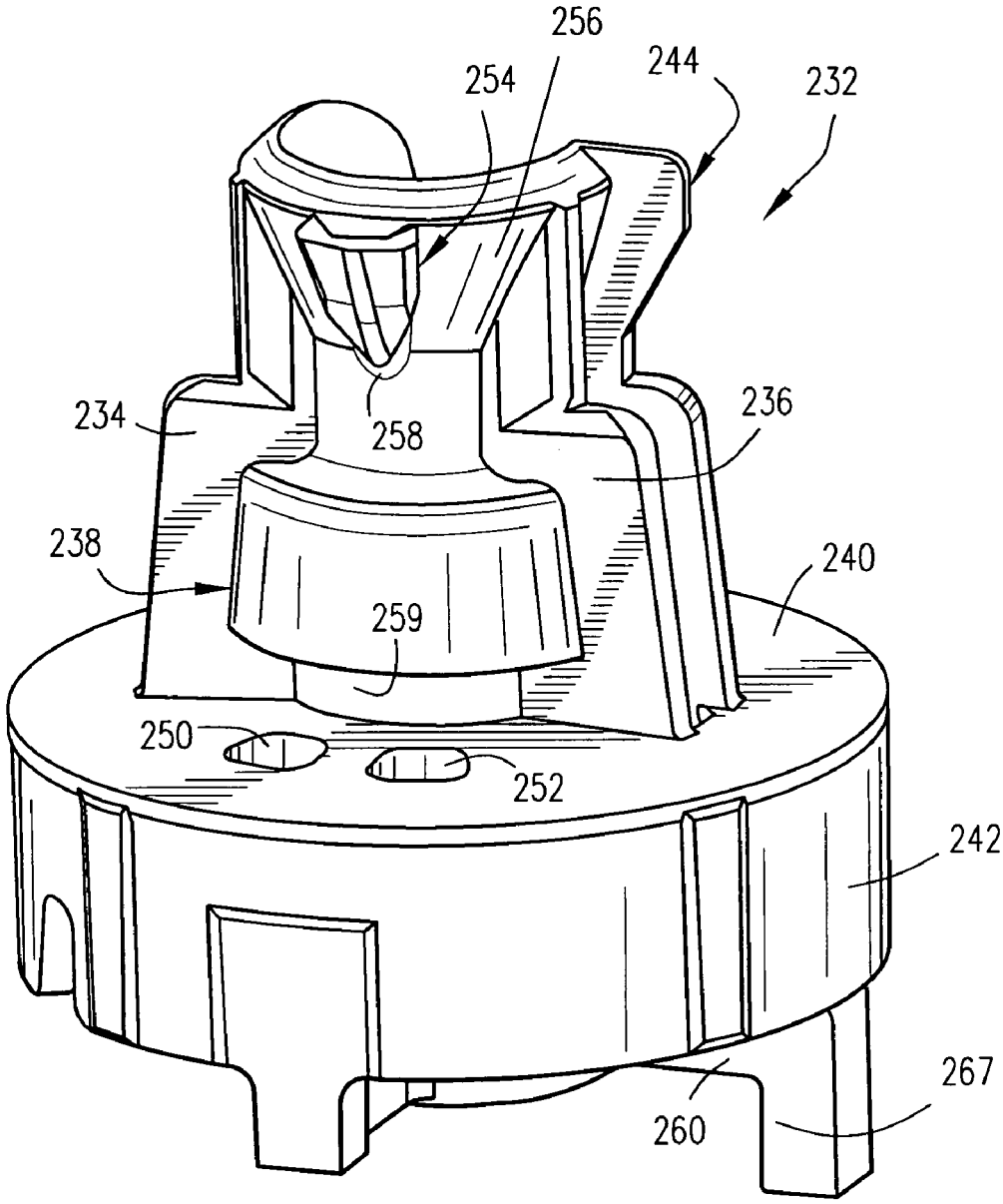
FIG. 17 of the deflector component in accordance with another exemplary embodiment of the invention.
Figure 18:
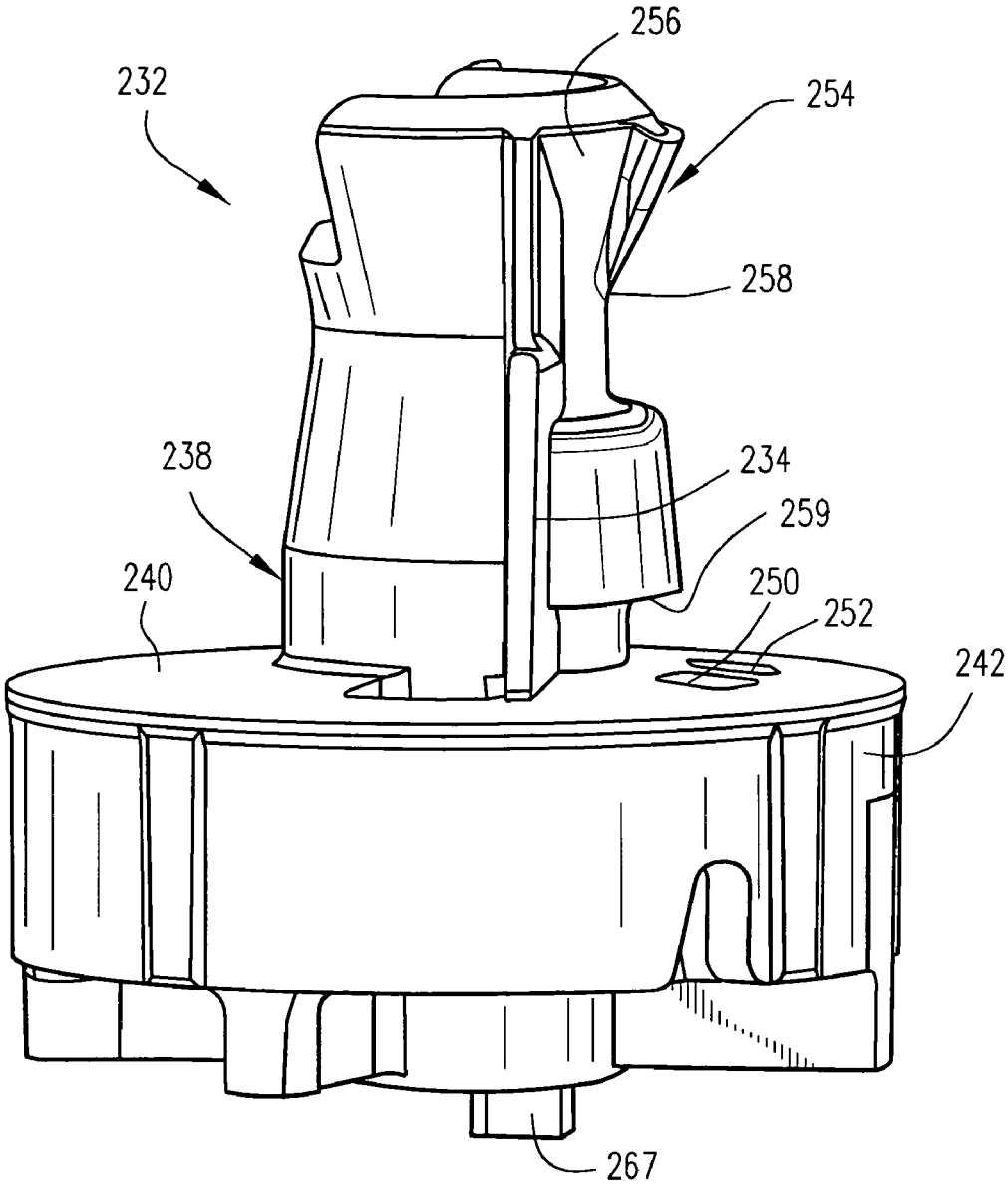
FIG. 18 is a side elevation of the deflector component shown on FIG. 17.
Figure 19:
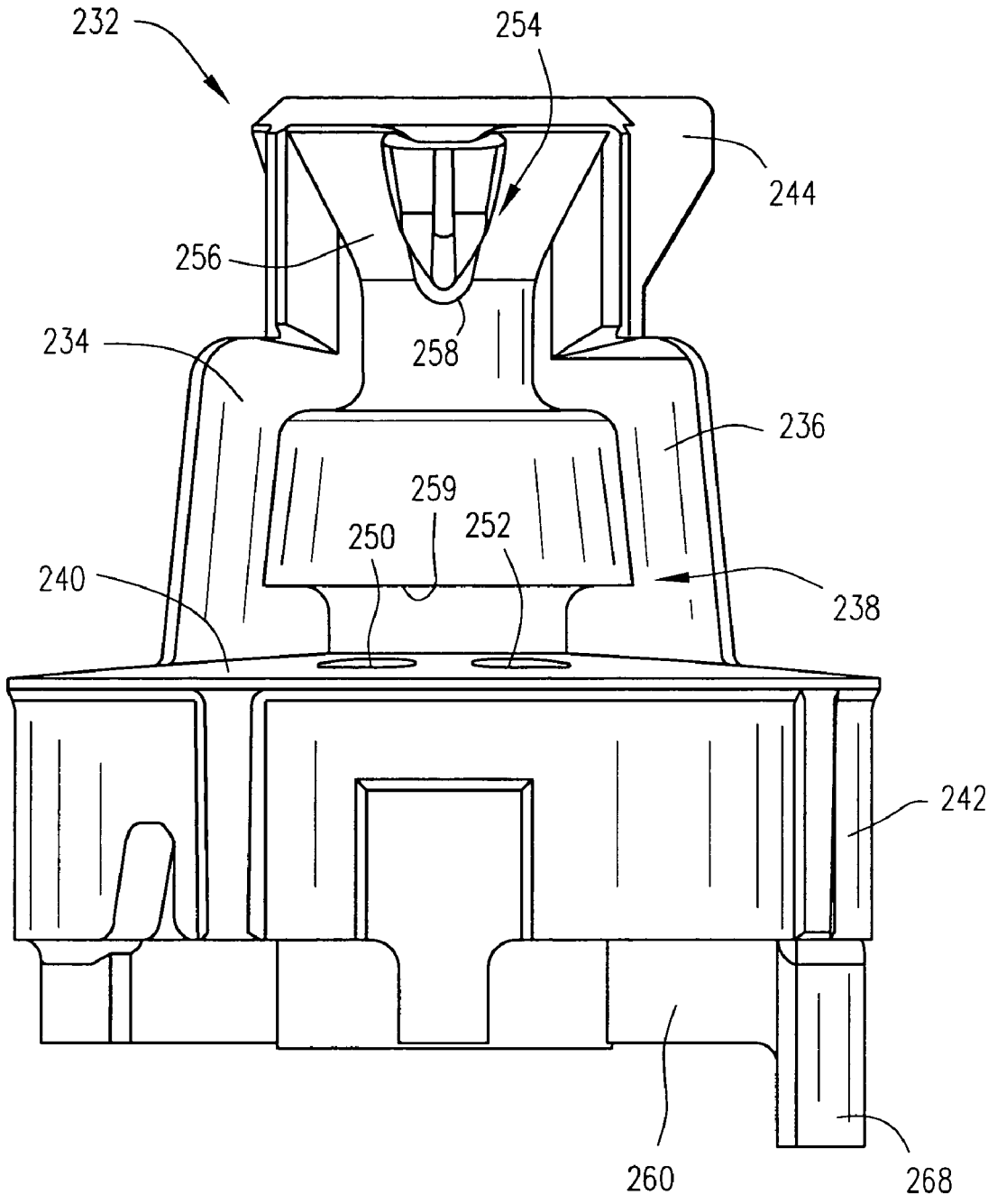
FIG. 19 is a side elevation similar to FIG. 18 but rotated 90° in a clockwise direction about a vertical axis.

FIGS. 15 and 16 illustrate in greater detail the nozzle 26 that is supported on the stream deflector 164 (within the stem 14) for rotation relative to the stream deflector. The nozzle 26 is a generally cylindrical member with a centered, axial opening that the deflector 164 and the shaft 20 pass through, with an arcuate surface 206 engaged by the hub 174 of the deflector. The nozzle 26 has an inlet end 208 and an outlet formed by an arcuate edge 210 with a rounded undercut 212 below the edge and a radially outwardly tapering surface 214 above the edge. Arcuate edge 210 is spaced radially outwardly of deflector surface 216 to thereby define the width of the arcuate discharge orifice. Circumferentially, the edge 210 extends approximately 250° from a first vertical surface 218 of an upstanding tab 220, to an edge 222 of a radial opening or notch 224. Vertical surface 218 thus comprises the "adjustable edge" of the nozzle orifice. Surfaces 204 (of the deflector) and 218 (of the nozzle) may also be referred to as defining "limit positions." Note that the tab 220 also seals against an hourglass-shaped (or cone-shaped) portion 226 (FIG. 11) of the deflector 164 that extends in either direction from surface 216. (The manner in which the nozzle 26 interacts with the stream deflector 164 remains as described in greater detail in the '905 and '332 patents). The nozzle 26 is also formed with a flat 230 (FIG. 15) that cuts across a portion of the teeth 96, and is used to facilitate auto-assembly with the stem 14.

Also as described above, when the nozzle 26 is in place, and with the rotor plate 18, stem 14 and deflector 164 extended relative to the base 12, a gear drive (or gear train) is established between the arc adjustment ring 22 and the nozzle 26 by reason of the engagement of teeth 80 on ring 22 with teeth 84 on the drive ring 82, and teeth 94 on the ring 82 with teeth 96 on the nozzle. Thus, rotation of the arc adjustment ring 22 will rotate the nozzle 26, relative to the deflector 164 to alter the arcuate length of the water discharge orifice between 90° and 210°.

The stream deflector 164 and its integral fixed edge 204 may be rotated to re-orient one edge of the pattern by simply turning the arc adjustment ring 22 beyond its normal range. In other words, the ring 22 may be rotated to its most restricted position (with a 90° opening). Then, through the application of additional torque on the ring 22, the drive ring 82, stem 14, stream deflector 164 and nozzle 26 (along with other of the internal components) will rotate together until the fixed edge 204 is in the desired position. The ring 22 can then be rotated in an opposite direction to achieve the desired arc of coverage between 90° and 210°. Conversely, the arc adjustment ring 22 may be rotated to the fully open position (210°), and then rotated beyond that position through the application of additional torque to reorient the fixed edge 204. The arc adjustment ring 22 may then be rotated in the opposite direction to shorten the arc to any position between 90°-210°.

Turning now to FIGS. 17 to 21, a modified stream deflector component 232 in accordance with an exemplary embodiment of this invention is able to produce, in combination with nozzle 26, a substantially rectangular wetted pattern area. The deflector is generally similar to the deflector 164 and only the modifications necessary to produce the desired pattern area will be discussed in detail below. Other minor changes in shape (as compared to deflector 164) are related to ease of manufacture, as dictated by plastic molding or metal shaping processes.

Figure 20:
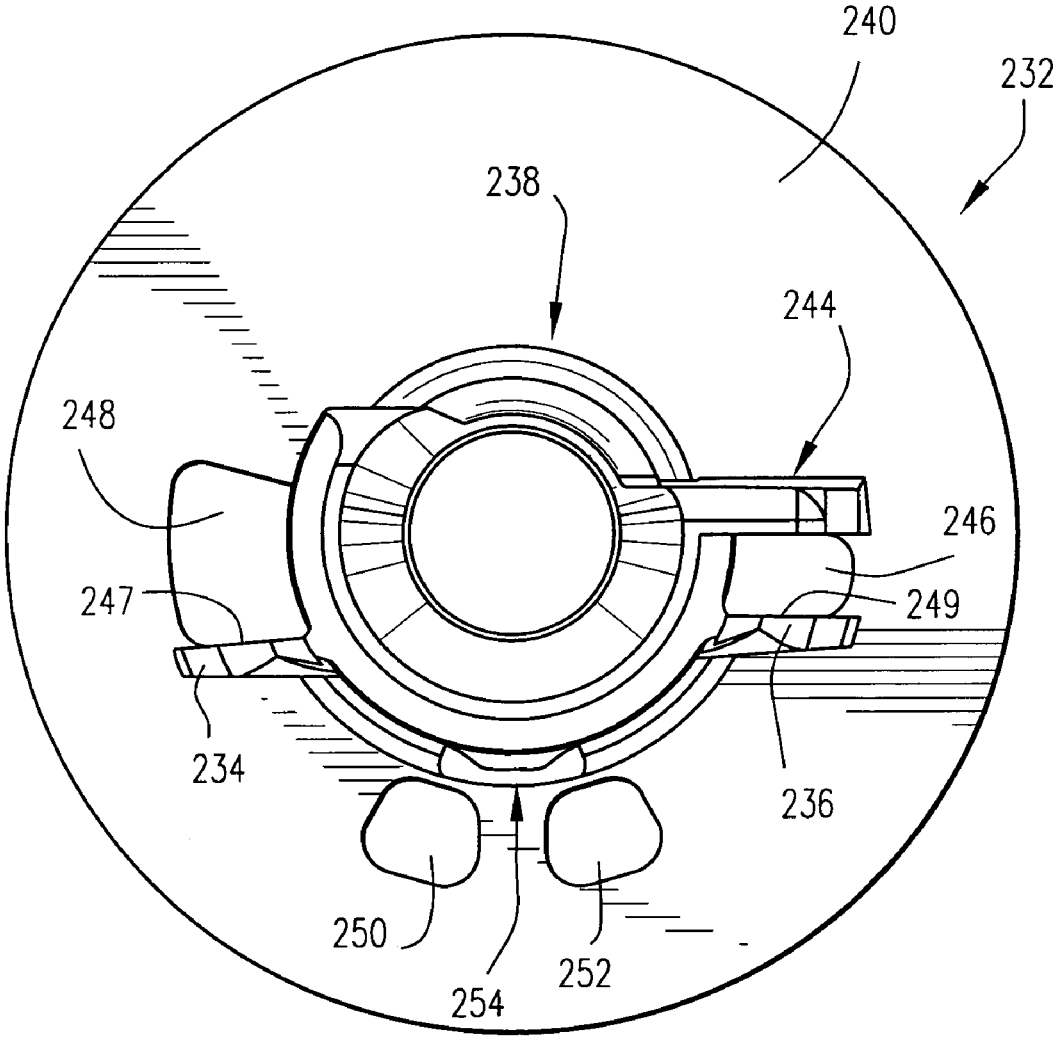
FIG. 20 is a plan view of the deflector shown in FIGS. 17-19.

In the modified deflector, a pair of upstanding ribs 234, 236 have been added to the center hub 238 above the slightly convex, or substantially horizontal wall surface 240 that otherwise closes the upper end of the annular ring or skirt 242. One rib 236 lies adjacent and parallel to the upstanding tab 244 (similar to tab 202). The circumferential space between the upstanding tab 244 (similar to tab 202) and rib 236 accommodates a first shortened arcuate slot 246 (FIG. 20) formed in the surface 240. The second rib 234 is circumferentially-spaced about the center hub 238 at a location such that ribs 234 and 236 lie substantially in the same vertical plane, best seen in FIG. 20. A second substantially arcuate slot 248 formed in surface 240 lies adjacent rib 234. The second substantially arcuate slot spans an angle of about 35°, as compared to the first substantially arcuate slot which spans an angle of about 15°. Note that 246, 248 have respective side edges 247, 249 that are defined by ribs 236, 234 that are not radial center lines, as best seen in FIG. 20.

A pair of restrictive flow ports 250, 252 are also formed in the wall surface 240, substantially circumferentially centered between ribs 234 and 236 (and hence between slots 246 and 248). A substantially V-shaped boss 254 is formed on the outwardly tapering surface 256 of the cone-shaped portion of the center hub 238, circumferentially centered between the ports 250, 252. The lower edge 258 of the boss is centered between the ports 250, 252, while the upper edge of the boss substantially spans the mid-points of the ports, From top-to-bottom, the boss 254 decreases in thickness, thus projecting a rounded wedge-shape from the tapered surface 256. Note also the undercut 259 formed in the hub above the ports 250, 252. The undercut helps to spread the water issuing from the ports 250, 252 in a lateral direction as explained further below.

Figure 21:
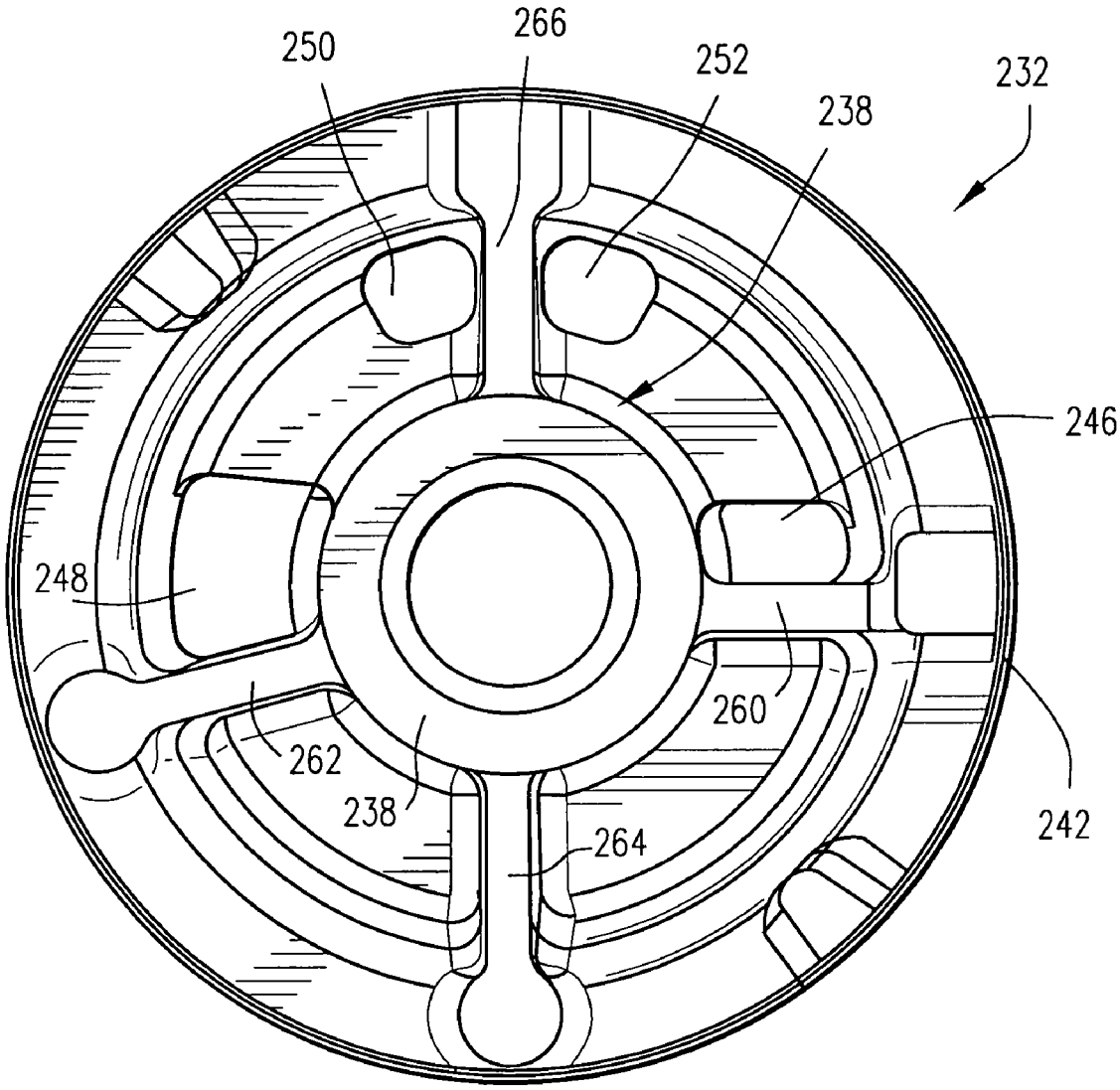
FIG. 21 is a bottom plan view of the deflector shown in FIG. 20.
Figure 22:
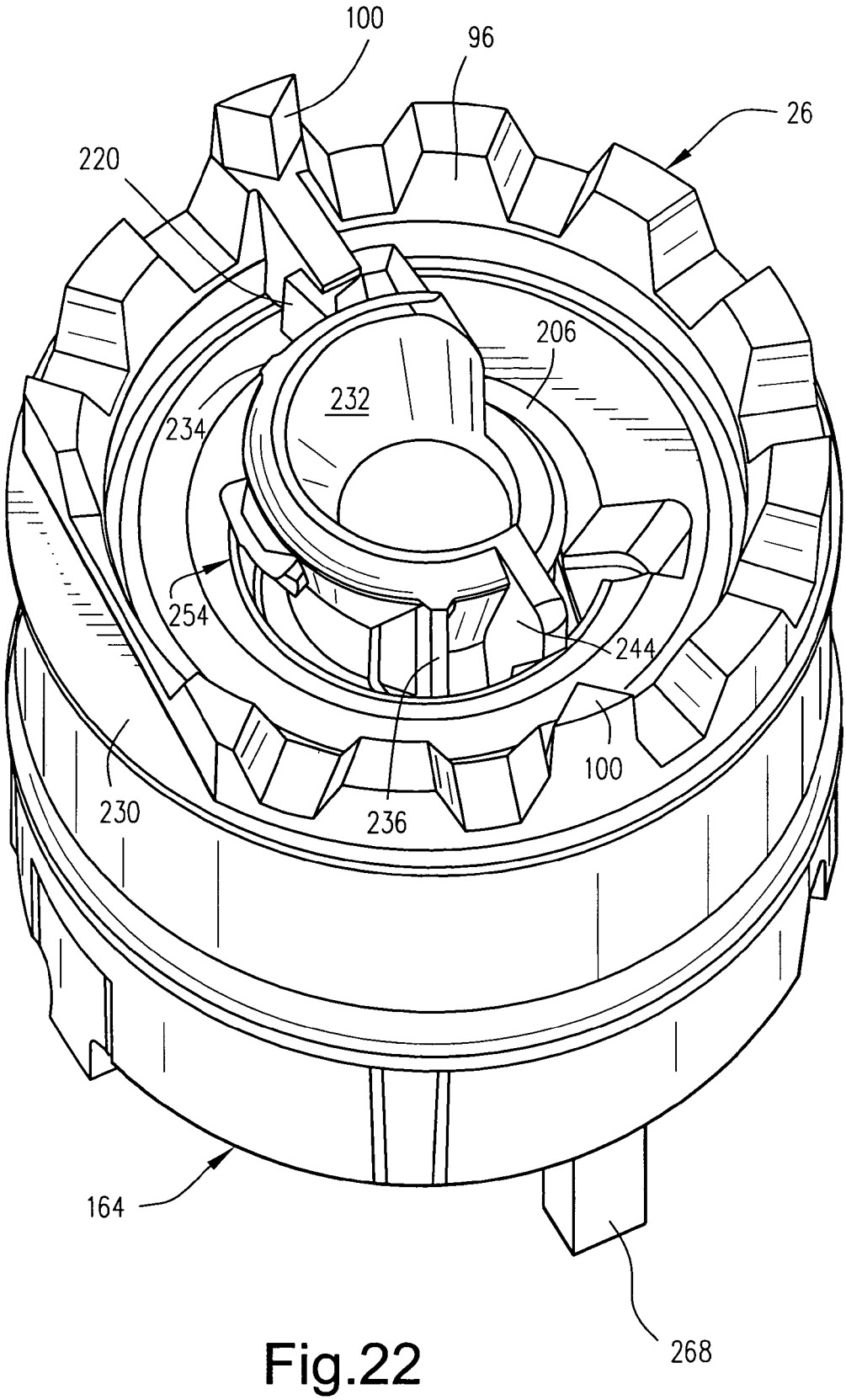
FIG. 22 is a top perspective view of the nozzles shown in FIGS. 15 and 16 in assembled relationship with the deflector shown in FIGS. 17-21.
Figure 23:
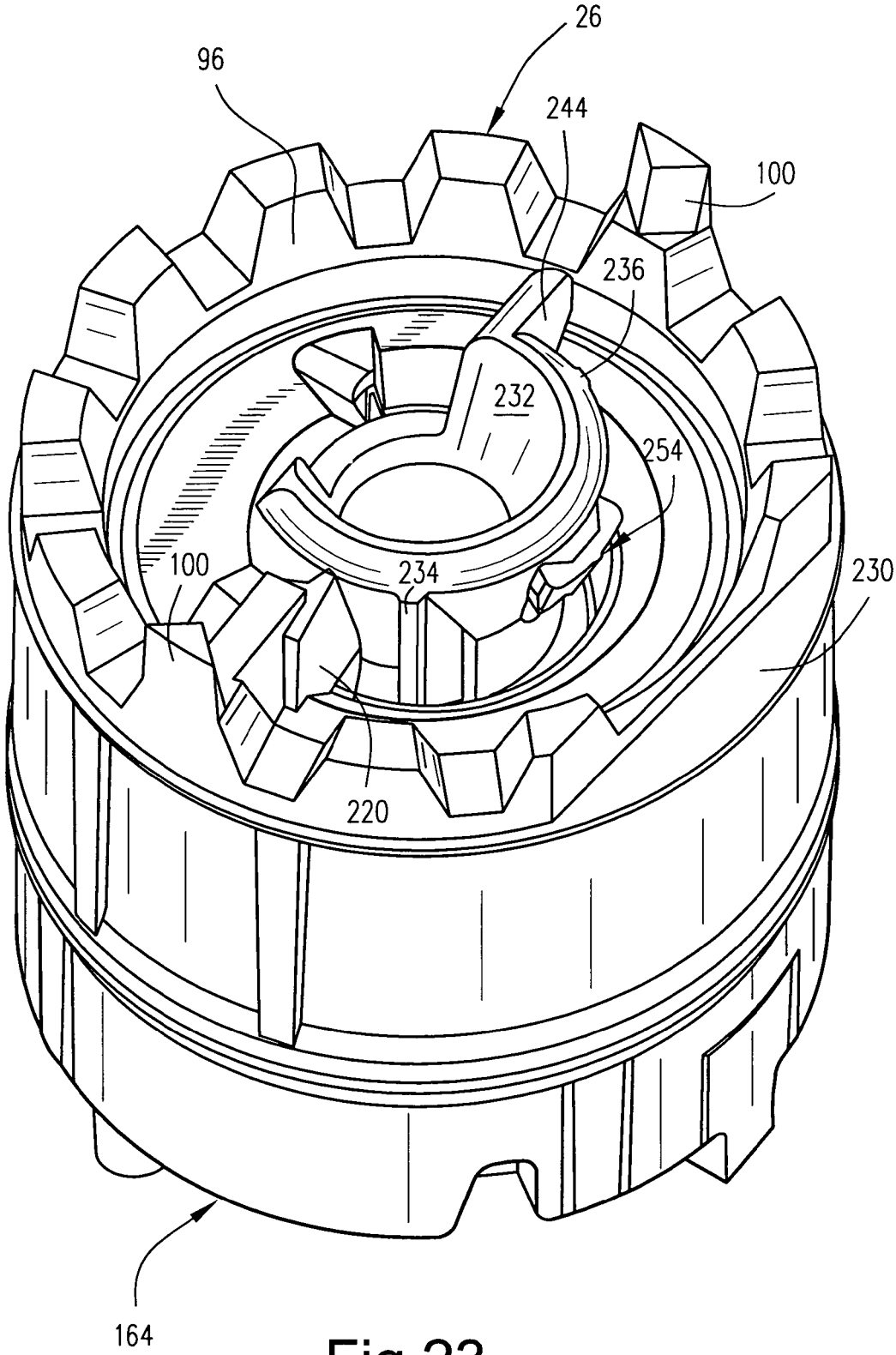
FIG. 23 is a perspective view of the nozzle and deflector component similar to FIG. 22, but rotated 90° in a counter-clockwise direction.
Figure 24:
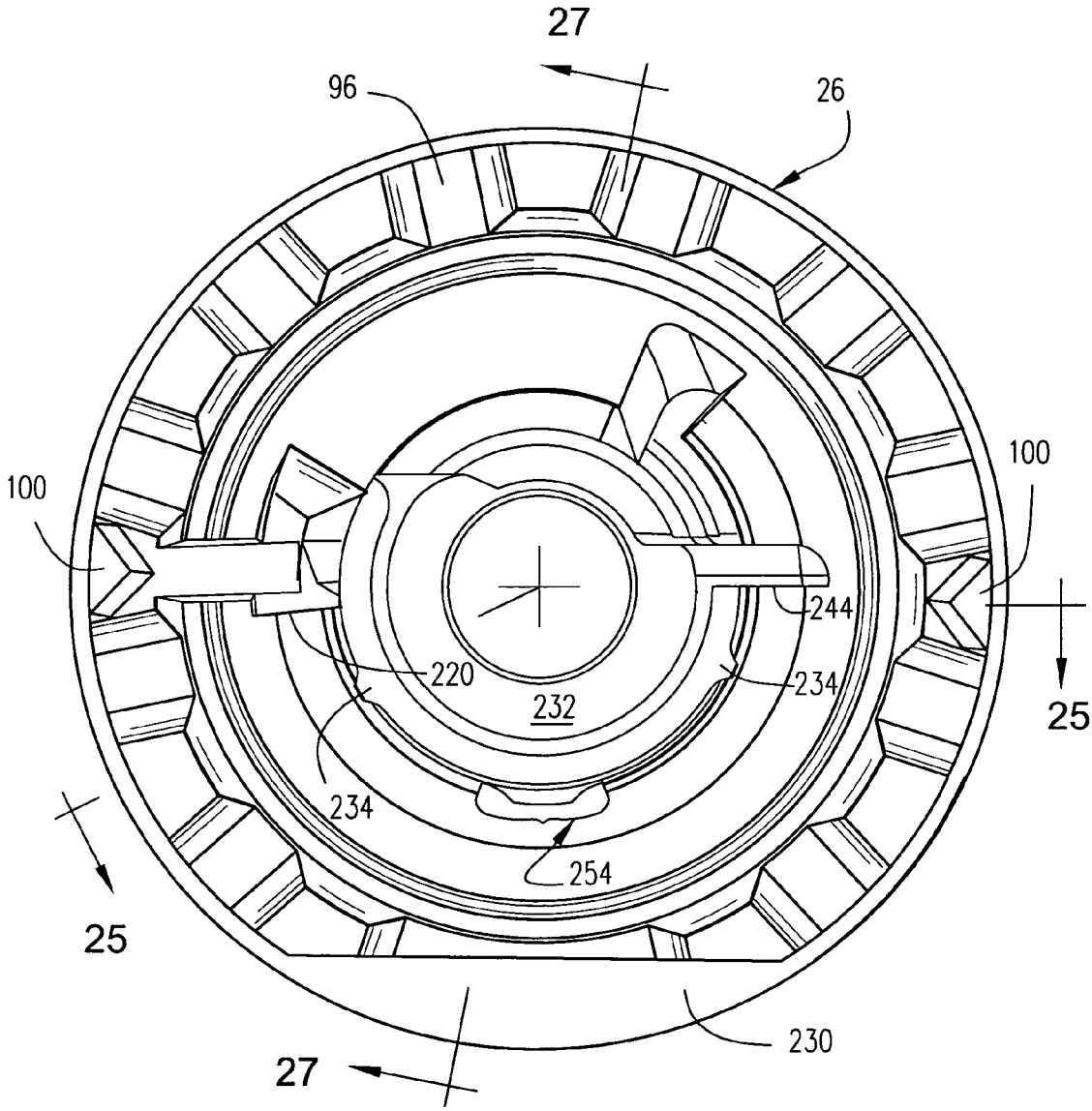
FIG. 24 is a top plan view of the deflector and nozzle in a fully assembled condition.
Figure 25:
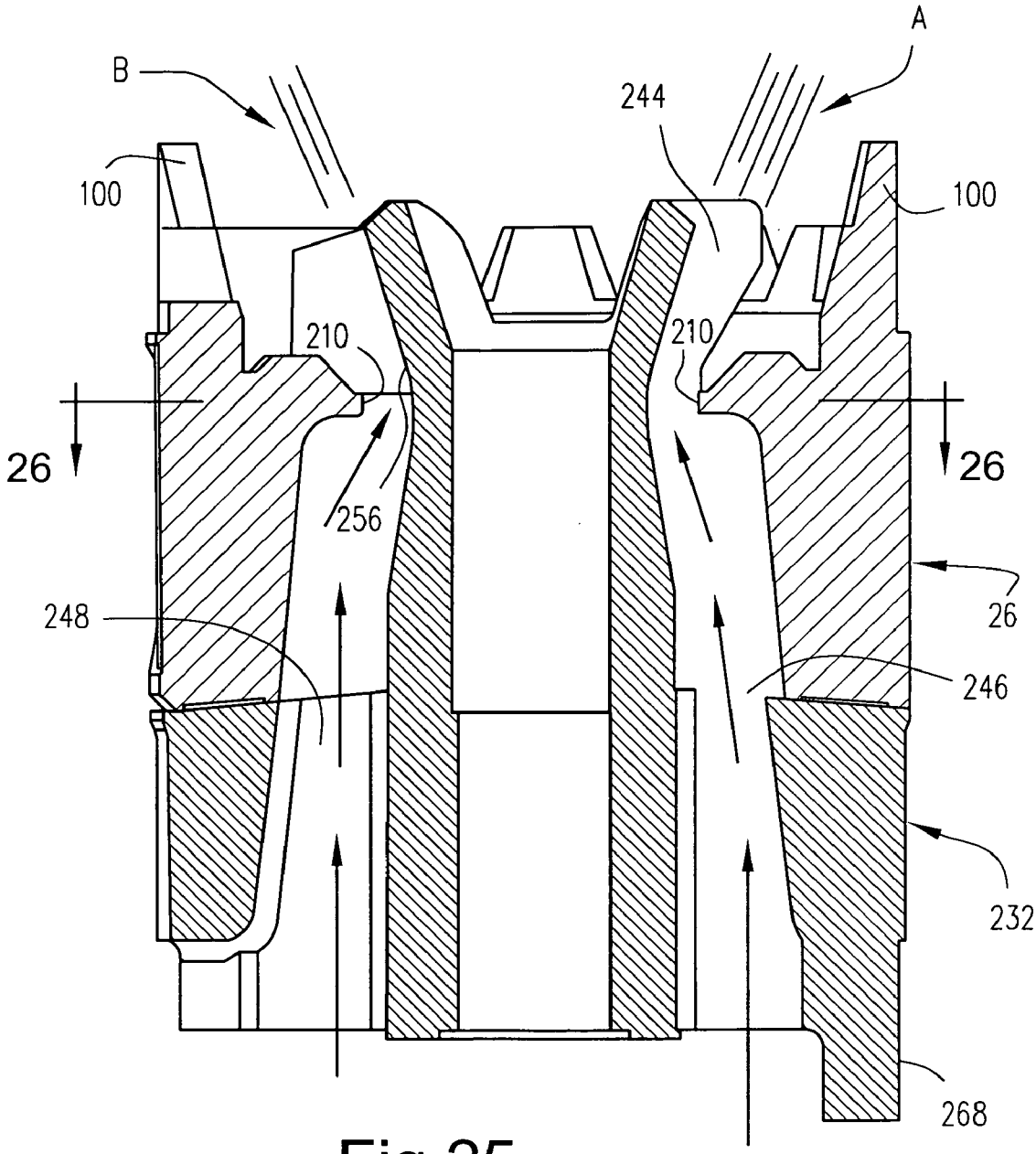
FIG. 25 is a cross section taken through line 25-25 in FIG. 24.
Figure 26:
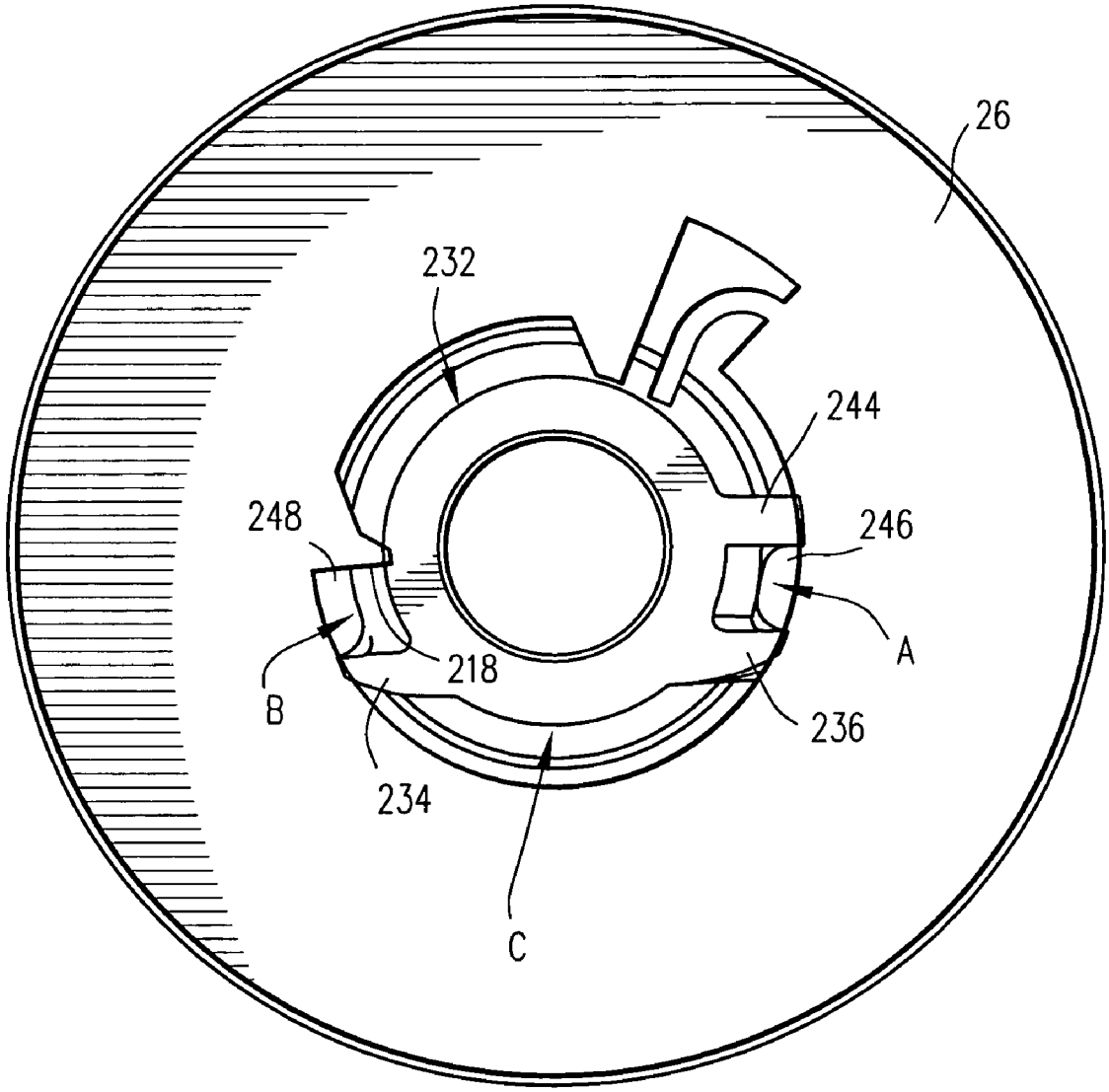
FIG. 26 is a section taken along the line 26-26 in FIG. 25.
Figure 27:
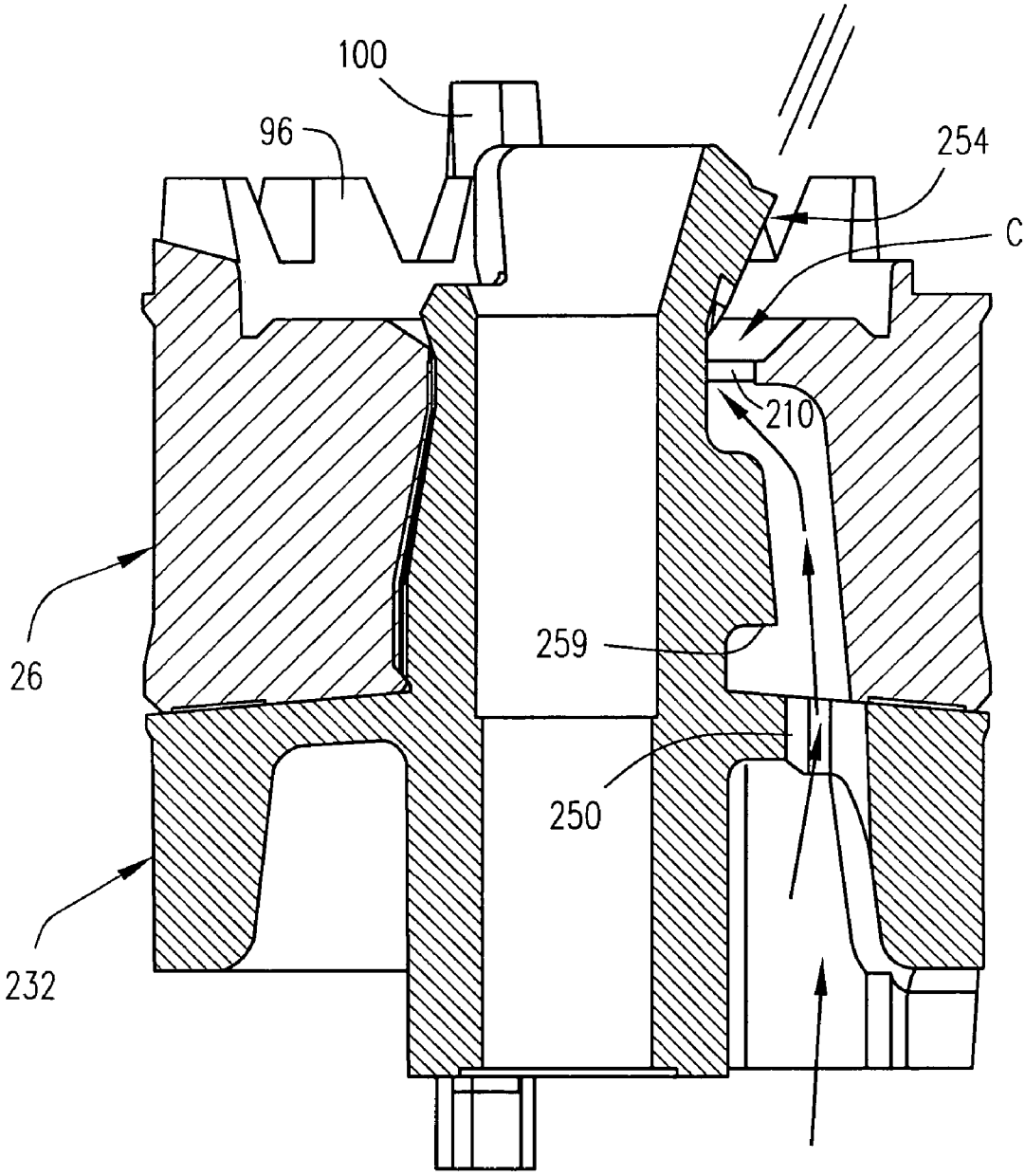
FIG. 27 is a cross section taken through the line 27-27 in FIG. 24.
Figure 28:
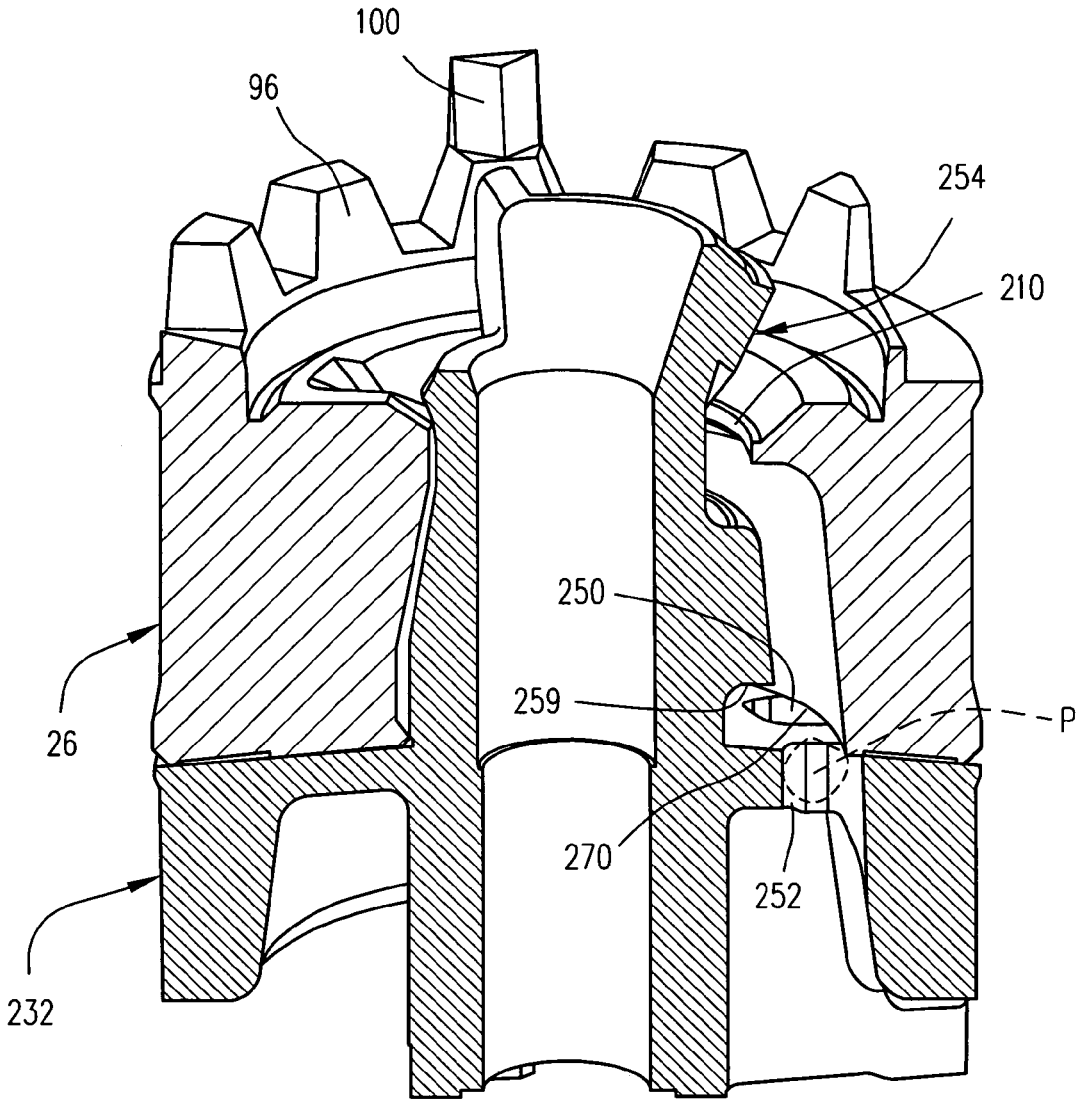
FIG. 28 is a perspective view of FIG. 27.

FIG. 21 shows the underside of the deflector 232, and the location of substantially arcuate slots 246, 248 and restrictive flow ports 250, 252 relative to the spokes 260, 262, 264 and 266 that connect the center hub 238 to the annular ring or skirt 242. More specifically, the first substantially arcuate slot 246 lies adjacent spoke 260 while the second substantially arcuate slot 248 lies adjacent spoke 262. Note that the vertical tab 244 is essentially an extension of spoke 260. Ports 250, 252 lie on either side of spoke 266. A downwardly extended portion 267 of spoke 260 serves as an assembly locator.

FIGS. 22 to 29 illustrate the modified deflector 232 in assembled relationship with the nozzle 26. As noted above, this nozzle is one that is otherwise used to obtain an arcuate pattern of between 90°and 210°. When assembled as shown in FIGS. 22-29, however, the nozzle orifice created by the tab 244 and edge 218 of the nozzle is separated into three discrete arcuate portions that defines sections A, B and C of the pattern P (see FIG. 30). The orifice sections will also be designated A, B and C for ease of understanding. Thus, with reference to FIGS. 25-28, the orifice section A is defined by the tab 244, rib 236 and part of arcuate nozzle edge 210 along with surface 256 of the deflector, and water is supplied unrestricted to this section via the substantially arcuate slot 246. The orifice section B is defined by rib 234 and vertical adjustment edge 218 of the nozzle, part of the arcuate nozzle edge 210 and surface 256 of the deflector. Water is also supplied unrestricted to this section via substantially arcuate slot 248. Thus, the streams emitted from orifice sections A and B are full-throw streams that are confined to narrow arcs, covering the lateral ends or sides of the pattern.

The larger arcuate orifice section C is defined by the ribs 234, 236 and a portion of the arcuate nozzle edge 210 and surface 256 of the deflector and is supplied with water subject to restriction via the ports 250,252.

Note also that with unrestricted water passages feeding water into orifice sections A and B, and exiting along the tapered or cone-shaped surface 256 of the deflector, normal full energy streams are produced in these two areas. Because the upstream ports 250, 252, however, restrict flow to orifice section C, the energy in the stream is reduced. In addition, this stream impinges on the undercut 259, and boss 254 which further shapes the stream to fill in the section C pattern between the areas watered by sections A and B.

Figure 29:
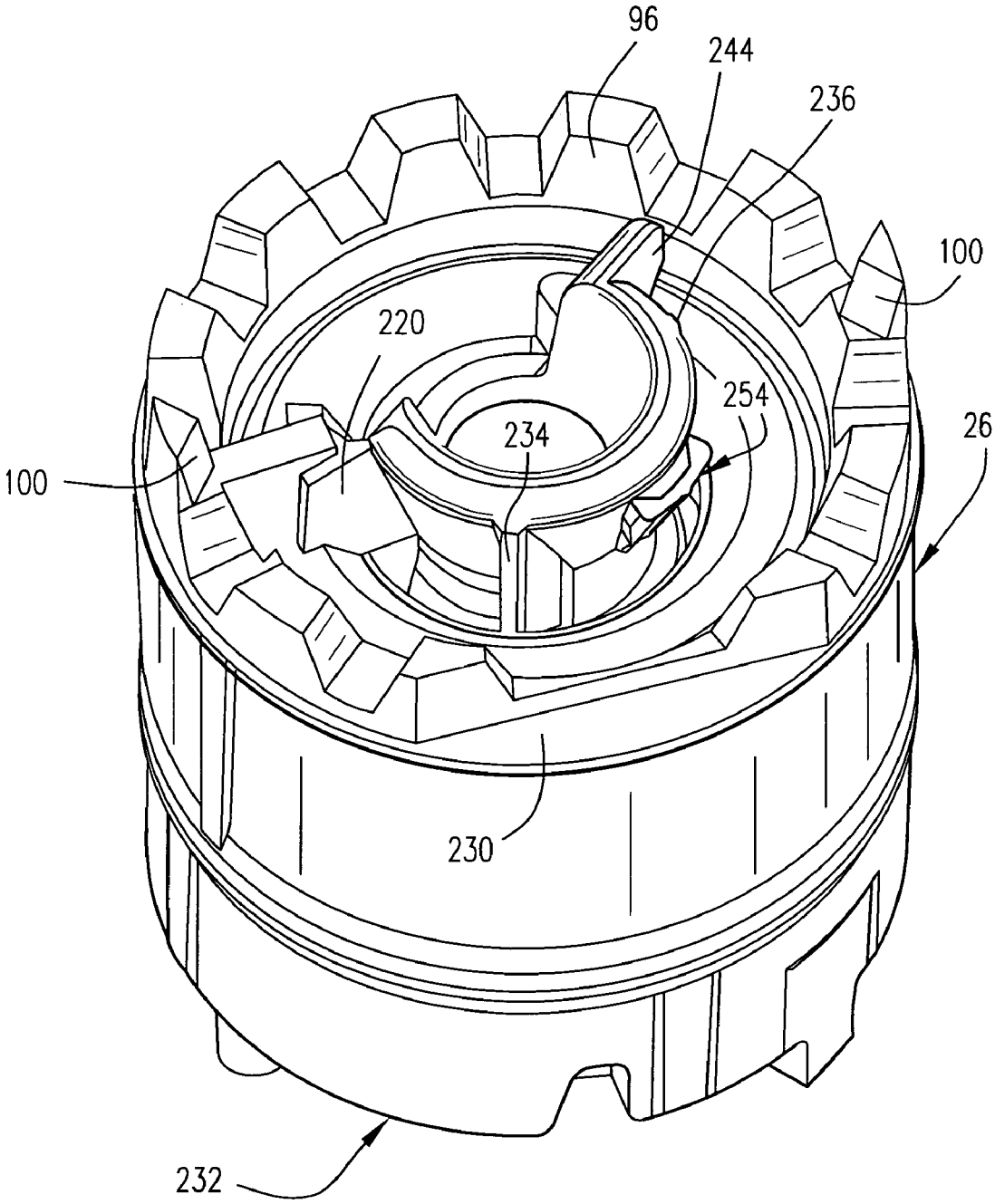
FIG. 29 is a perspective view of the assembled nozzle and deflector components with the nozzle edge set to increase the wetted area by 30°.
Figure 30:
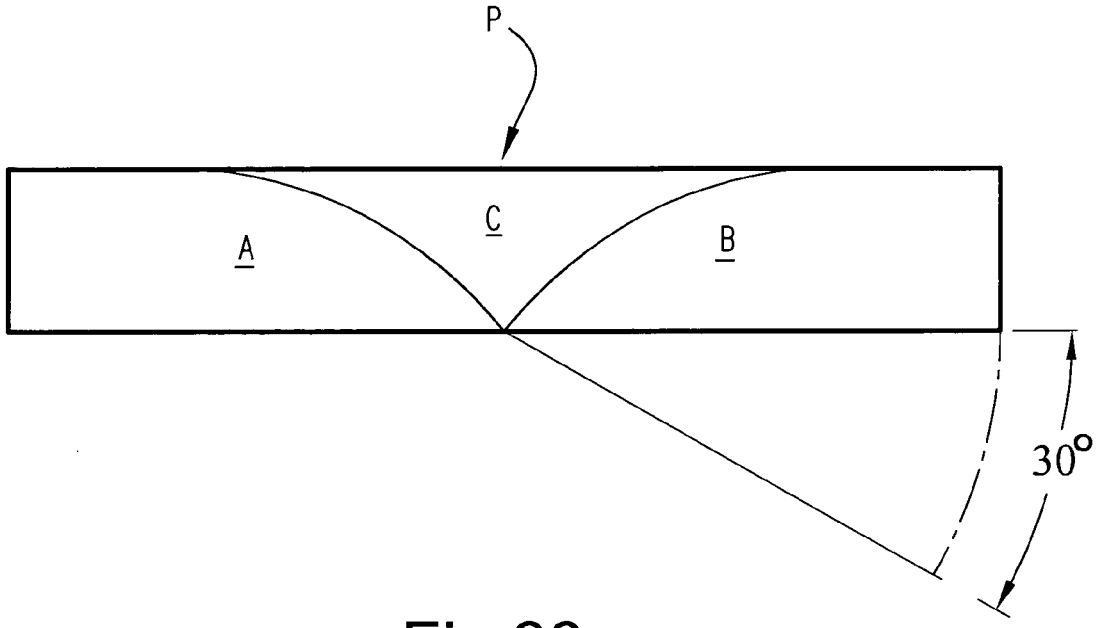
FIG. 30 is a schematic diagram illustrating a substantially rectangular wetted pattern area, with an option for extension along one side in accordance with the invention.

Note that by rotating the nozzle to enlarge the section B orifice, utilizing the entire arcuate extent of slot 248 in the deflector, section B can be enlarged up to about 30° as illustrated in FIGS. 29 and 30. With specific reference to FIG. 28, should any particle P find its way through the sprinkler filter and lodge in one of the restrictive flow ports 250, 252, the relative rotational movement of the lower nozzle edge 270 across the ports 250, 252 may reorient any such particle P so that it is flushed through the device, i.e., passed through the nozzle orifice in section C.

In an alternative arrangement, the pattern may be fixed to produce a set rectangular pattern, with no relative rotation possible between the deflector and nozzle. The size of the pattern may, of course, be reduced by throttle adjustment as explained above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary sprinkler comprising a sprinkler body supporting a nozzle body and a water distribution plate supported on a shaft downstream of said nozzle body, said water distribution plate provided with a plurality of grooves shaped to redirect a plurality of discharge streams emitted from said nozzle body and to cause the water distribution plate to rotate when struck by the stream, said nozzle body having an outlet defined by an edge; a stream deflector comprising a center hub extending axially along said shaft, said stream deflector supported within said sprinkler body with the center hub extending through the outlet of the nozzle body such that the center hub of the stream deflector is at least partially radially surrounded by the edge of said nozzle body to allow water to pass between the center hub and the edge; wherein said stream deflector comprises a pair of vertical ribs and a surface that cooperates with said edge to define a first discharge orifice section, said stream deflector further comprising a pair of slots that cooperates with said edge to define second and third discharge orifice sections disposed on either side of said first discharge orifice section, and wherein the discharge orifice sections are configured to disperse water passing therethrough in the plurality of respective discharge streams to impinge on said water distribution plate to produce a substantially rectangular wetted pattern area.

2. The rotary sprinkler of claim 1 wherein said stream deflector comprises at least one port disposed upstream of said first discharge orifice section for restricting flow to said first discharge orifice section.

3. The rotary sprinkler of claim 1 wherein said second and third discharge orifice sections define opposite ends of the rectangular pattern and further wherein one of said second and third discharge orifice sections is adjustable to enlarge one end of said substantially rectangular wetted pattern area.

4. The rotary sprinkler of claim 1 wherein said stream deflector includes a center hub formed with a bore for receiving said shaft, said center hub extending through a radially enlarged ring portion having an annular skirt, said ring portion closed at an upper end thereof by a substantially horizontal surface surrounding said center hub, said pair of slots provided in said substantially horizontal surface.

5. The rotary sprinkler of claim 2 wherein said surface tapers radially outwardly in a downstream direction.

6. The rotary sprinkler of claim 1 wherein one of said slots extends about 15° and the other of said slots extends about 35°.

7. The rotary sprinkler of claim 1 wherein one of said second and third discharge orifice sections is further defined by one of said pair of vertical ribs and an upstanding tab.

8. The rotary sprinkler of claim 7 wherein one of said slots lies between said one of said pair of vertical ribs and said upstanding tab, and the other of said slots lies adjacent the other of said pair of vertical ribs.

9. The rotary sprinkler of claim 8 wherein said stream deflector includes a center hub formed with a bore for receiving said shaft, said center hub extending through a radially enlarged ring portion having an annular skirt, said ring closed at an upper end thereof by a substantially horizontal surface surrounding said center hub, said pair of slots provided in said substantially horizontal surface.

10. The rotary sprinkler of claim 9 wherein said center hub comprises an undercut above said horizontal surface, extending circumferentially between said pair of vertical ribs.

11. The rotary sprinkler of claim 10 wherein said surface is formed with a radially projecting boss for flattening the stream exiting said first discharge orifice section.

12. The rotary sprinkler of claim 11 wherein said horizontal surface comprises at least one port for restricting flow to said first discharge orifice section.

13. The rotary sprinkler of claim 12 wherein said horizontal surface further comprises a pair of ports for restricting flow to said first discharge orifice.

14. The rotary sprinkler of claim 13 wherein said pair of slots are formed in said horizontal surface, providing unrestricted flow to said second and third discharge orifice sections.

15. A rotary sprinkler comprising a sprinkler body supporting a nozzle body and a water distribution plate supported on a shaft downstream of said nozzle body, said water distribution plate provided with a plurality of grooves shaped to redirect a plurality of discharge streams emitted from said nozzle body and to cause the water distribution plate to rotate when struck by the stream, said nozzle body having an edge; and a stream deflector supported within said sprinkler body, said stream deflector comprising a wall surface and a center hub extending upwardly from the wall surface, said stream deflector being supported within said sprinkler body with said center hub being at least partially radially surrounded by the edge of said nozzle body, said stream deflector comprising a pair of slots and at least one port positioned therebetween that are formed in the wall surface thereof, the stream deflector further comprising a pair of vertical ribs separating the slots and the at least one port and cooperating with said edge to disperse water passing therethrough in the plurality of respective discharge streams to impinge on said water distribution plate to produce a rectangular wetted pattern area.

16. A rotary sprinkler comprising a sprinkler body supporting a nozzle body and a water distribution plate supported on a shaft downstream of said nozzle body, said water distribution plate shaped to redirect a plurality of discharge streams emitted from said nozzle body and to cause the water distribution plate to rotate when struck by the streams, said nozzle body having an edge; a stream deflector supported within said sprinkler body and surrounded by said nozzle body, said stream deflector comprising an upstanding tab and at least one vertical rib, said upstanding tab and said vertical rib extending vertically adjacent to the edge of said nozzle body such that the edge, the upstanding tab, and the vertical rib cooperatively define at least first and second discharge orifice sections, wherein said at least first and second discharge orifice sections are configured to disperse water passing therethrough in the plurality of respective discharge streams to impinge on said water distribution plate to produce a substantially rectangular wetted pattern area.

17. The sprinkler of claim 16 wherein said one of said plurality of discharge orifice sections comprises a center discharge orifice section and second and third discharge orifice sections located at opposite ends of said center discharge orifice section, and wherein flow to said second and third discharge orifice sections is unrestricted.

18. The rotary sprinkler of claim 1, wherein said discharge orifice sections cooperate to produce a rectangular wetted pattern area.

19. The rotary sprinkler of claim 1, wherein said water distribution plate is provided with a plurality of grooves shaped to redirect a stream emitted from said nozzle body and to cause the water distribution plate to rotate when struck by the stream.

20. The rotary sprinkler of claim 2, wherein said port is formed in a horizontal wall surface of said stream deflector.

21. The rotary sprinkler of claim 15, wherein said wall surface is horizontal.

22. The rotary sprinkler of claim 1, wherein the vertical ribs extend through the outlet of the nozzle body.

23. The rotary sprinkler of claim 15, wherein the vertical ribs are at least partially radially surrounded by the edge of the nozzle body.

24. The rotary sprinkler of claim 16, wherein the vertical rib and the upstanding tab are at least partially radially surrounded by the edge of the nozzle body.

25. The rotary sprinkler of claim 16, further comprising at least one slot and at least one port providing flow to the plurality of discharge orifice sections.

26. The rotary sprinkler of claim 25, wherein said at least one slot and said at least one port are formed in a wall surface of said stream deflector.

* * * * *

UNITED STATES PATENT AND TRADEMARK OFFICE

CERTIFICATE OF CORRECTION

PATENT NO. : 7,611,077 B2
APPLICATION NO. : 11/349347
DATED : November 3, 2009
INVENTOR(S) : Sesser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 712 days.

Signed and Sealed this

Twelfth Day of October, 2010

David J. Kappos

David J. Kappos
*Director of the United States Patent and Trademark Office*